United States Patent [19]

O'Neal et al.

[11] 3,934,793

[45] Jan. 27, 1976

[54] VOTING MACHINE

[75] Inventors: Cothburn M. O'Neal, Dallas; Alfred M. Mayo, Richardson, both of Tex.; George William Childs, deceased, late of Dallas, Tex.; by Patricia M. Childs, executrix, Dallas, Tex.

[73] Assignee: Accuvote, International, Inc., Dallas, Tex.

[22] Filed: May 28, 1974

[21] Appl. No.: 473,925

Related U.S. Application Data

[62] Division of Ser. No. 309,174, Nov. 24, 1972, Pat. No. 3,866,826.

[52] U.S. Cl. ..... 235/51

[51] Int. Cl.[2] ..... G07C 13/00

[58] Field of Search ..... 235/51, 54 R, 50 A, 50 B, 235/54 A, 54 B, 54 C, 54 D, 54 E

[56] References Cited

UNITED STATES PATENTS

| | | | |
|---|---|---|---|
| 1,194,337 | 8/1916 | Lausterer | 235/54 C |
| 2,826,365 | 3/1958 | Shoup | 235/51 |
| 3,233,826 | 2/1966 | Wiken | 235/51 |
| 3,346,177 | 10/1967 | Crossland | 235/51 |
| 3,512,707 | 5/1970 | Moldovan, Jr. | 235/51 |

*Primary Examiner*—Stephen J. Tomsky

*Attorney, Agent, or Firm*—Hubbard, Thurman, Turner & Tucker

[57] ABSTRACT

A compact, versatile voting machine is disclosed having adaptability for use with various vote registering devices such as tally counters and punch card apparatus. The voting machine includes a selector mechanism having a series of parallel columns housing voter operated key slides. A vertical interlock mechanism includes ball housing blocks which are alternately disposed between the key slides and house displaceable interlock balls in a tool line. The cam blocks are adjustable to limit the effective length of the tool line to establish groupings of candidates from which a single selection can be made. A magazine at the top of each column is adjustable to permit multiple selections from a grouping. Actuation of a key cams the interlock balls into the tool line, and when a predetermined number of voter selections have been made no additional keys can be actuated as they are blocked by the tool line. A row of adjacent horizontal keys can also be interlocked to established selection groups as typically found on a general election ballot. A bar is moveable to horizontally interlock adjacent columns by introducing locking pins into a position to be cammed by actuation of a key. A drive mechanism associated with each column permits the voter to vote straight party and clears the machine to ready it for another voter. The drive mechanism includes cam controlled clutches that operate four-bar linkage elements to depress or return the key slides. A judge controlled mechanism locks the machine between voters. For various voting requirements, judge operated cam arrangements are cooperable with the horizontal locking pins and the four-bar linkage to selectively lock out partial or entire columns or rows of key slides. The key slides are provided with a voter viewable button that registers a visible, luminescent "X" when a key is voted.

23 Claims, 37 Drawing Figures

FIG. 19
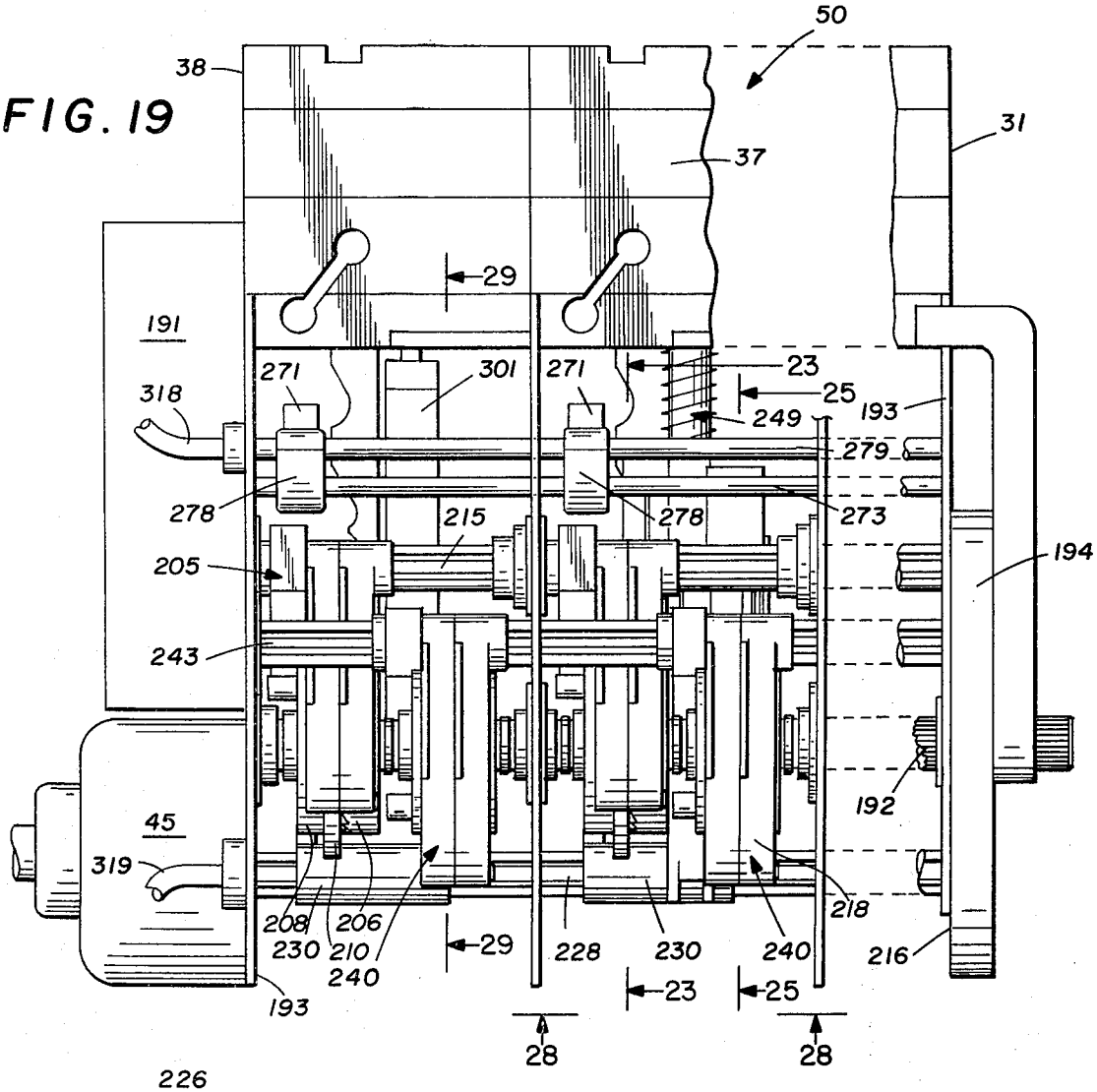
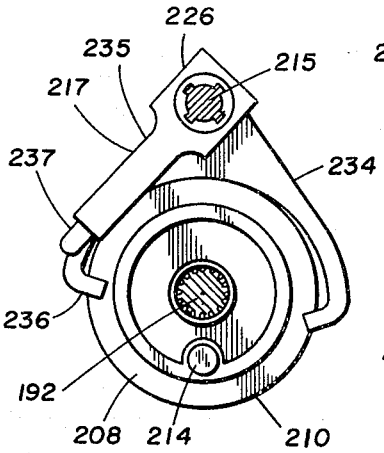
FIG. 20
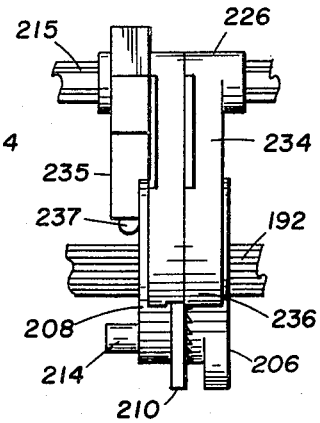
FIG. 21
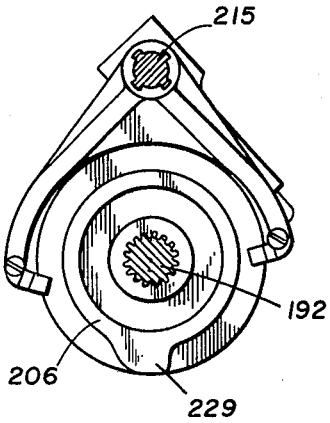
FIG. 22

VOTING MACHINE

This is a division of application Ser. No. 309,174, filed Nov. 24, 1972, now U.S. Pat. No. 3,866,826.

This invention relates to voting machines and more particularly is directed to improved voting machines of the general construction described in prior U.S. Pat. Nos. 3,168,240 and 3,524,969.

A large number and variety of mechanical voting machines cna be found in the prior art. Machines most commonly found in use today are of the type as shown in the U.S. Pat. No. 3,408,002 and the patents referred to therein.

These machines are generally referred to as "lever-type" voting machines and have found general acceptance and are widely used. In lever machines, multiple horizontal or vertical rows of selector levers are interconnected by cranks or similar mechanisms to counter mechanisms which register the number of votes cast for a particular candidate or issue.

Machines of this general type have a number of disadvantages. One of the foremost disadvantages of the lever-type machines is their extreme size and weight, often in excess of 500 pounds. Because of the weight, a single machine requires the effort of several men to transport the machine from its place of storage to the polls. Further, the large size requires an extreme amount of storage space when it is considered that a city of, for example, one million people may own or lease several thousand voting machines. Transportation and storage of the machines during periods of non-use can constitute a major financial burden on a governmental unit.

Aside from the above-mentioned problems of storage and transportation, the lever-type machines require complex procedures on the part of the custodian to prepare the machine for voting, particularly when the machine is to be used in primary elections. In primary elections it is common that one or more candidates will be selected by the voter from a larger group running for the office and, accordingly, the columns must be broken down into subgroups of the correct number of candidates. The subgroups are established by various interlock arrangements which usually require that grouping pins or compensators be inserted in the columns to serve as barriers to permit only a selected number of voting keys to be depressed within the column. This can be a difficult operation requiring skill and much preparation time on the part of reelection officials in order to insure proper machine functioning.

Another disadvantage of the lever-type voting machine is that the accompanying ballot is often confusing and difficult for the voter to understand because it does not duplicate the format of the traditional paper ballot. This is especially true of machines having horizontal selection rows which require a specialized ballot format to adapt to the machine. It is generally accepted practice for conventional paper ballots to display the candidates in a vertical rather than a horizontal arrangement.

It is the primary object of the present invention to provide a simple to operate, console type voting machine of substantially reduced size and weight to facilitate handling and storage. The present invention employs a very efficient, compact selector mechanism using displaceable steel balls arranged in columns which permit lists of candidates for more than one office to be placed in a single column. Further, the columns can be set so that one or more selections from that list can be made by the voter. Such an arrangement would be typically used in a primary election. The voting machine of the present invention also permits adjacent vertical columns to be mechanically interlocked so that the selection groups on the ballot can be arranged horizontally as is necessary in a general election.

The present invention further has provision for straight party, write-in, and random voting procedures and insures that the voter cannot disenfranchise himself by casting two opposing votes. The voting machine of the present invention also makes chain voting impossible. A unique clutch mechanism performs multiple functions including a clearing and locking function after each voting cycle and when a straight party selection is made.

The present invention also permits insertion of a computer compatible card into the machine on which card is recorded the voter's selections. This card may then be processed by computer to expedite computation of the election results and minimize decoding and transcription. The machine adapts to the requirements of almost any election and the ballot can be arranged in a format familiar to most voters. The buttons are depressed and the voted buttons are easily identifiable to the voter by an "X" appearing at the voted button. In summary, the present invention provides a voting machine having improved interlock systems to render the machine simple, efficient, lightweight, and yet at the same time highly versatile and applicable to a variety of voting procedures and adaptable to the various voting laws and requirements in effect in the various jurisdictions throughout the country. These and other objects of the present invention will become apparant from the following drawings and descriptions in which:

FIG. 19 is a view of the drive assembly as seen from the top end of FIG. 2;

FIGS. 20 to 22 are detail views of drive assembly clutches;

Figure 1:
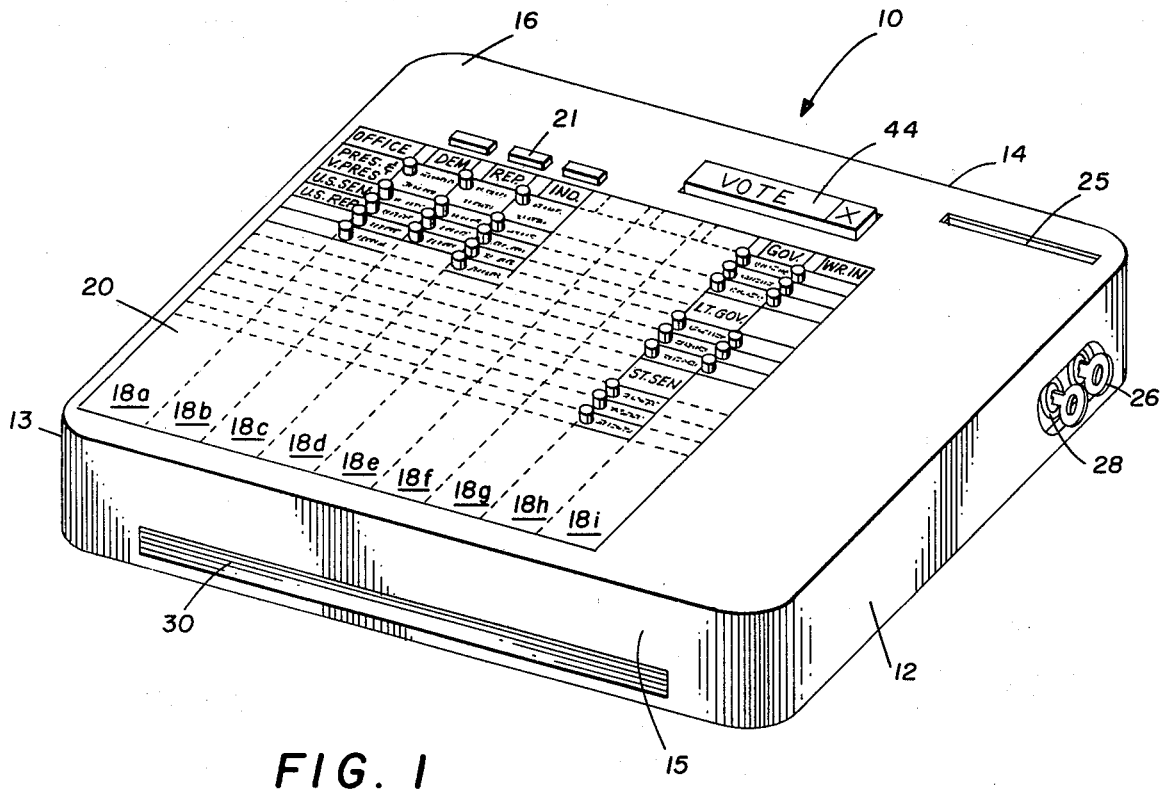
FIG. 1 is a perspective view of the voting machine of the present invention with a representative ballot in place.

The voting machine is shown in FIG. 1 and is generally designated by the numeral 10. The machine would generally be incorporated in an appropriate voting machine cabinet, not shown, when placed in use. The cabinet would provide for either a vertical or horizontal mounting of the mechanism for voter access depending on preference and voting requirements. The machine 10 generally has a basic frame structure comprising opposite side members 12 and 13 and opposite end members 14 and 15. A top panel 16 is carried by the frame structure and has provision for mounting of the ballot 20. The ballot is divided into a series of eight vertical selection columns identified 18*a* through 18*i*. It should be noted, as used throughout this description, the term "horizontal" means a plane parallel to ends 14 and 15 of the machine. The term "vertical" refers to a plane parallel to sides 12 and 13.

Ballot 20 is not typical ballot one would find when voting but rather is a representative ballot to illustrate the operation of the machine. Left hand columns 18*a*, 18*b*, 18*c* and 18*d* are set up in a format corresponding to that used in most general and some city elections in which several political parties offer candidates for the same offices as are listed in column 18A. As shown, the voter would make a choice for the office of president from either columns 18*b*, 18*c*, or 18*d* and, once having voted one of the selections, is not permitted by the interlock system of the present invention to make another selection for that office. Column 18*h* illustrates a typical primary election ballot wherein one selection is chosen from several candidates to be the particular party's candidate in the general election. It will be appreciated that any other number of rows could as well be provided. At the top of each of columns 18*b* to 18*d* is a straight party button 21 which, as will be more fully explained hereafter, when depressed will cause all the voting keys in the associated vertical column to be depressed, clearing all other buttons on the machine. A slot 25 in the upper right hand of the machine is provided to accept a data processing card which is punched in response to the voting operation. A resetting lock 26 is used to lock or release the mechanism after each vote is recorded preparing the machine for the next voter. Lock 28 operates the column lockouts to lock out of operation certain selected columns or partial columns. The keys for lock 26 and 28 are retained by the election judge or official on duty at the election location. When the voter has completed making selections, main vote button 44 initiates the machine through its operative cycle. A tray 30 accessible through front 15 contains the tally counters and a public counter. One tally counter is provided to correspond to each of the voting buttons on the machine. For a more complete description and understanding of the operation the candidate counters and the card insert and card punching mechanism, please refer to commonly assigned co-pending application entitled "Punch Assembly and Method of Making Same", U.S. Ser. No. 309,192, and commonly assigned U.S. Pat. No. 3,821,522, granted June 28, 1974, entitled "Counter", both filed concurrently herewith.

Figure 2:
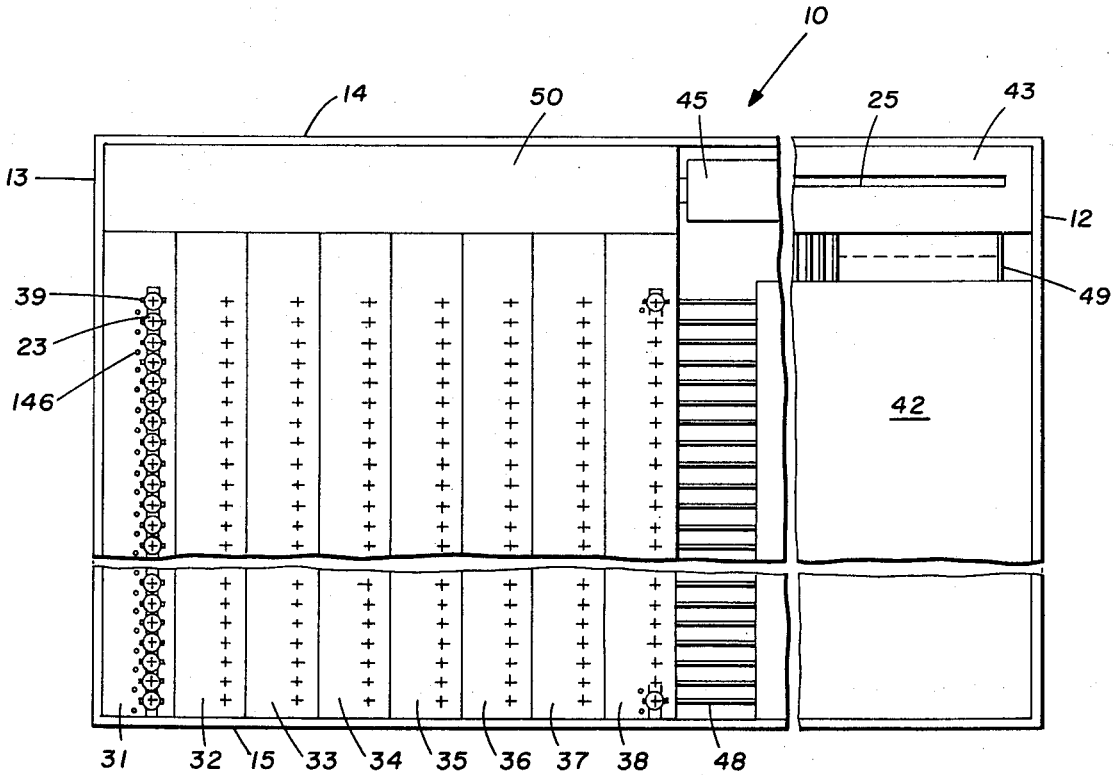
FIG. 2 is a front view of the voting machine with the ballot removed.
Figure 3:
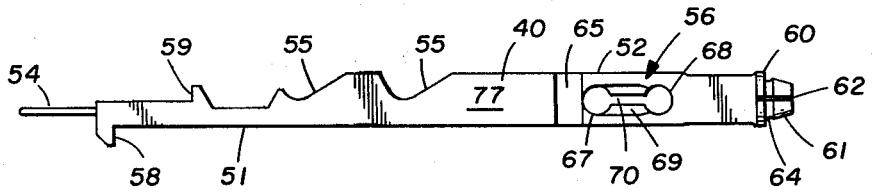
FIGS. 3, 4 and 5 are elevational views of a voting key.
Figure 4:
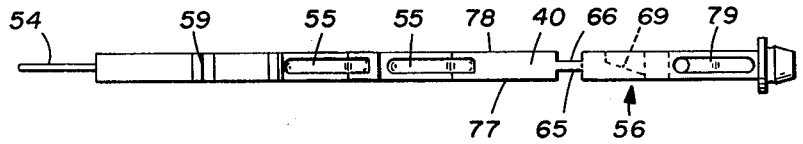
Figure 5:
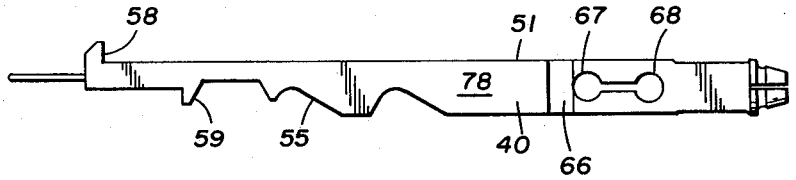

FIG. 2 illustrates a machine of the present invention with the ballot 20 and cover plate 16 removed to expose the basic components of the machine. The rectangularly arranged frame members 12, 13, 14, and 15 support eight vertical column members 31 through 38. Each of the columns 31 to 38 are similar in construction and each is generally elongate and provided with a vertical row of slots 39 therein which slidably receive the end key slides 40. Slot 146 provides access to a cam device for setting up vertical selection subcolumns. The details of the key slides are shown in FIGS. 3 through 6 and are discussed in the following paragraphs. The purpose of the present brief description is to outline the interaction of the main components so that the operation of the voting machine wil be more easily understood. To make a selection, key slides 40 are manually depressable through a voting button 23 extending through the panel 16 and ballot 20. Tray 30 containing the tally counters is horizontally positioned subjacent columns 31 to 38 and depression of a key slide 40 will engage a corresponding counter in the tray 30 through plunger 54 at the terminal end of slide 40. The counters may be of the well known star wheel type or similar to those disclosed in the co-pending application referenced above.

Also operatively engaging each of the key slides is a rod 48 which extends transversely of the columns and is received in punch bank selector 42. Rods 48 are horizontally displaced to the right by actuation of the corresponding key slide by cam surfaces 55 on the slides 40. Rightward movement of a transverse bar 48 into the punch bank selector 42 will block a corresponding punch selector bar 49 so that upon actuation of the voting cycle by main voting button 44, the card inserted in slot 25 of card punching mechanism 43 will be perforated in a pattern corresponding to the voter's choice. Clearing of the machine and actuation of the straight party cycle is by virtue of the multiple clutch drive mechanism 50 shown at the upper portion of the machine. An electric motor 45 powers the mechanism through the clearing and straight party cycles as will be explained. Provision can be included for manually driving the machine by a crank in case of a power failure.

The foregoing is just a brief description of the various main components to the machine so that their relative location and interrelationship may be appreciated. The operation and mechanism of the counter assembly and the punch mechanism form no part of the present invention but rather are the subject of the separate aforementioned patent applications. The present invention concerns itself with the voter selection mechanism and more particularly with the interlock arrangement for setting up and limiting voting selections and the clutch-drive mechanism for clearing the machine and for voting a straight party ticket.

Referring now to FIGS. 3 through 6, the voting key slide 40 is shown in detail. The key slide 40 comprises an essential part of the machine which is operative to register the voter's selections. Key 40 extends laterally in slots 39 in each of the columns and each is manually depressible through button 23 by the voter. Each key 40 includes an upper generally rectangular shank portion 52 and a lower extension 51 having opposite sides 77 and 78. Opposite transverse slots 65 and 66 extend across the intermediate portion of the key 40. Angular cam surfaces 55 are provided on one edge of the key. The cam surface 55 on each slide is associated with the end of transverse punch actuator bars 48. The longitudinal position of cam surfaces 55 along extension 51 varies with the column in which the key slide 40 is located. For example, cam surfaces 55 on the key slides located in column 38 are immediately adjacent the shank 52 and the location of the corresponding cam surfaces 55 is displaced downwardly for the slides in each leftwardly successive row. In this way, all rods 48 that are associated with the keys in a horizontal row of key slides are in vertical alignment beneath the columns. The rods 48 are configured to avoid interference with the adjacent key slides.

Inward of the lower end of the key 40 a shoulder 59 projects laterally. Shoulder 59 is adapted to be engaged by a clear bar of the drive mechanism 50 to return the key to a non-actuated position. Extending from the opposite side of the key is projection 58 which is adapted to be engaged by a bar in drive 50 to pull the associated key 40 downwardly when a straight party button 21 is actuated on the machine. The clear and straight party mechanism is actuated by drive mechanism 50, as will later be explained.

An important feature of this invention is the vertical interlock arrangement which limits the number of voting buttons a voter can depress within a column by blocking the remaining slides when the predetermined number of selections has been made. The vertical interlock is achieved by camming accurate steel balls in a tool line extending through the columns along a cam surface on the keys 40. Each key is provided with cam means 56 including adjacent circular bores 67 and 68 extending through the shank of the key slide. A semicircular camming surface 69 extends approximately at a 30° angle from the edge of bore 67 at surface 77 toward the edge of hold 68 at surface 78. Axial slot 70 extends between bores 68 and 69 through the intermediate cam surface 69.

Figure 6:
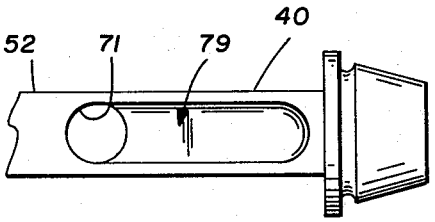
FIGS. 6 and 7 are enlarged detail views of the end of the voting key.
Figure 7:
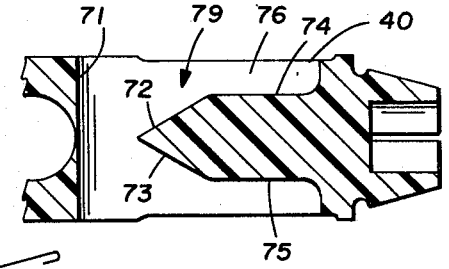

The vertical interlock mechanism permits the election official to set up the machine in vertical selection column as, for example, would be necessary in a primary election. Other elections may require that the machine be programmed horizontally as in a general election. Accordingly, an important feature of the present invention includes means to selectively interlock adjacent horizontal keys to define a selection group and so that only one key can be voted within the group. As best seen in FIGS. 6 and 7, a cam 79 is provided on the upper end of the slide 40 in opposite sides which cooperate with horizontal locking pins to prevent actuation of more than one key within a group. The cam means includes bore 71 that extends transversely through the shank portion 52 of the slide 40. cam 79 includes generally V-shaped surfaces 72 and 73 which intersect bore 71 at the longitudinal centerline of the shank portion. As best seen in FIG. 7, surfaces 72 and 73 diverge outwardly to oppositely arranged lands 74 and 75, respectively, which are all commonly defined within recess 76 in the opposite edges of the key 40.

FIGS. 9 to 11 and 16 to 18 best show the relationship of the slides 40 in the columns. Keys 40 are all received in adjacent vertical columns 31 to 38 aligned vertically and horizontally. Each column contains a selected number of keys. The following description is with reference to column 33 whicih is typical. column 33 is a generally elongated rectangular section and has an aligned series of slots 82 which receive the main body portion of keys 40. Enlarged slots 39 aligned with slots 82 extend to the surface of the column. A shoulder 84 at the bottom end of each slot 39 serves as a stop to engage outwardly extending flange portion 60 of the associated key. Thus, looking at FIG. 11, which is a sectional view through a portion of adjacent columns, key 40 is shown in a normal unactuated position; when actuated it will be moved inwardly until flange 60 contacts shoulder 84 at the bottom of slot 39. An over center toggle pin, not shown, may be associated with each key slide 40 to give the key a positive action to cross bore 85, approximately corresponding in diameter to the cross bore 71 in the shank portion of key slide 40, intersects column slot 82 and terminates in rectangular slot 86 which extends longitudinally in column 33. Horizontal interlock bar 90 is slidable in slot 86. Another longitudinal channel 91 extends the length of column 33 perpendicular to the axis of key slide 40 and intercepts slots 82 and houses vertical interlock ball housing blocks 110 which, as will be described later, are interposed between and cooperate with vertically adjacent keys 40 in the vertical interlock mechanism.

Figure 11:
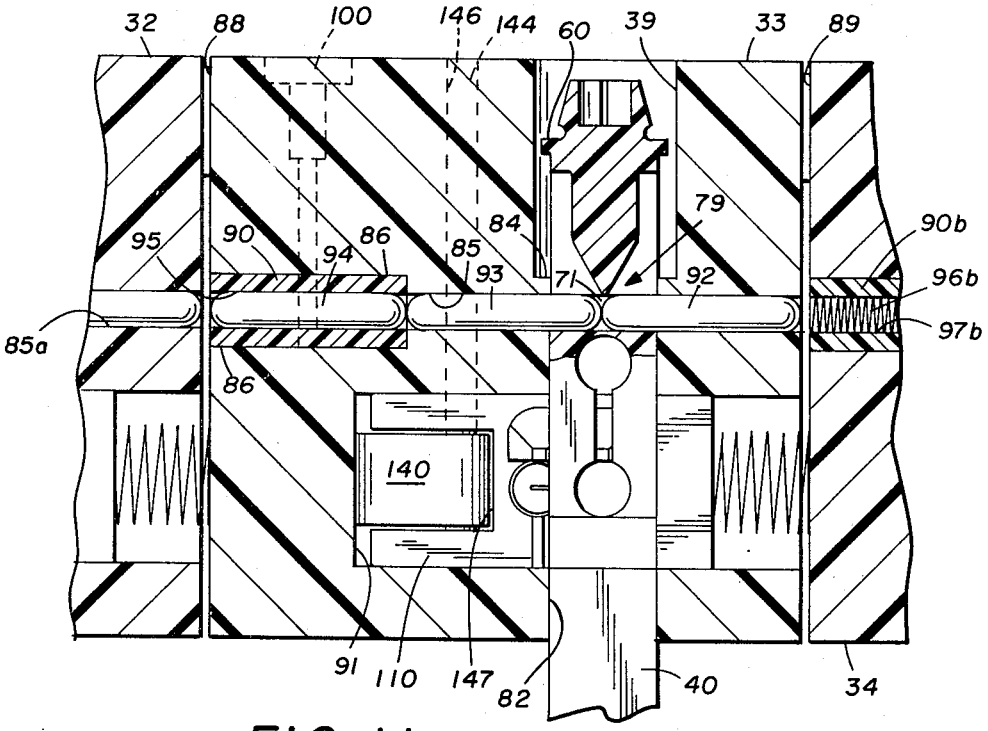
FIG. 11 is an enlarged partial sectional view taken along lines 11—11 of FIG. 9.

As seen in FIG. 11, a pair of plungers 92 and 93 in the form of pins having rounded ends are positioned in cross bore 85. The pins are dimensioned so that pin 92 extends from the center line of the slide key at the apex of the cam surfaces 72 and 73 to the edge 89 of the column 33 next adjacent column 34. Similarly, plunger 93 extends leftwardly from the center line of slide 40. Column 32 next abuts column 33 at edge 88 having bore 85a in direct alignment with slot 86 of column 33. Similarly, at side 89, adjacent column 34 has its interlock bar **90*b* in direct alignment with bore 85 of column 33.** The subscripts "*a*", "*b*", etc., here and throughout the specification, designate identical or similar elements.

Interlock bar 90 extends the vertical length of column 33 in slot 86. A number of cross bores 95 are provided in bar 90 and are spaced so that the distance between bores 95 is half the distance between adjacent vertical cross bores 85 in the columns. Every other bore 95 houses a compression spring 96 forming a socket 97. A slidable plunger 94 extends in bores 95 not housing a spring.

Figure 12:
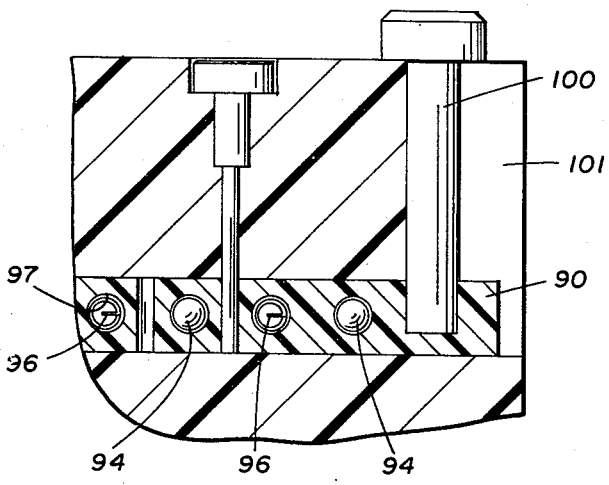
FIG. 12 is a partial sectional view showing the end of the lockout bar mechanism.

Referring to FIGS. 11 and 12, the interlock bar 90 is vertically shiftable relative to the associated column to move either a plunger 94 or a spring socket 97 in axial alignment with column cross bores 85. An acutating handle 100 is connected to the lower end of bar 90 and projects into recess 101 in the column. Manually moving actuator handle 100 will displace bar 90 to position the bar in accordance with the election requirements.

It will thus be understood, referring to FIG. 11, that as key 40 is depressed in response to a voter operation, the cam surface 79 will be urged between adjacent plungers 92 and 93 parting them in opposite directions. If it is desired to horizontally interlock adjacent vertical columns, as for example when the machine is set up as shown in ballot columns 18b, 18c and 18d of figures, actuator 100 in column 33 is moved to position interlock bar 90 to align plungers 94 in the bar with bores 85 of the column. The interlock bars in columns 32 and 34 are similarly positioned. For example, when a key 40 in column 33 is depressed, associated plunger 93 will move leftwardly urging adjacent plunger 94 in bar 90 leftwardly into engagement with pin **92*a* located in the adjacent column. Pin 92*a* in adjacent column 32 will be moved into blocking engagement beneath the apex of associated cam 79*a*** of the key slide in that column.

Figure 13:
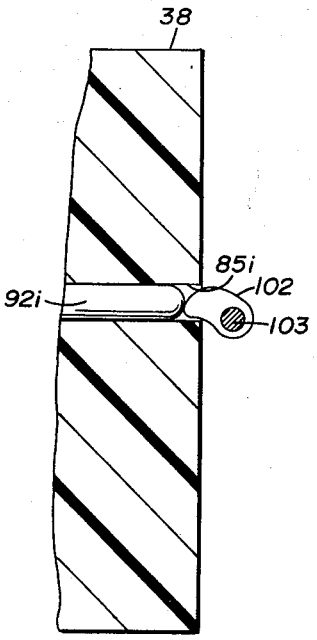
FIG. 13 is a partial detail view showing a cam arrangement.

Column 34 located immediately adjacent side 89 of column 33 has been preset having its interlock bar **90*b* positioned with spring sockets 97*b* in axial alignment with cross bores 84 of column 33. Upon depression of a key slide 40 in column 33, pin 92 will simply move into engagement in socket 97*b* causing spring 96*b* to be depressed. The axial motion of plunger 92 will not be transferred across interlock bar 90*b* to prevent the actuation of the key slides in column 34. Therefore, looking at an arrangement of FIG. 1, it will be seen that by selectively positioning interlock bar 90, horizontal listings of candidates may be made and the selection limited to one candidate from the preselected row or group across the columns. The interlock bar between adjacent columns can be positioned to either interlocking or isolate the columns, as the case may be. An entire or partial horizontal row of key slides 40 may be locked out by virtue of cams 102 as seen in FIG. 13. Cams 102 are rotatively mounted on cam shaft 103 immediately adjacent column 38. Each cam aligns with cross bore 85*a* in that column. To lock out a horizontal row of keys, associated cam 102 is rotated into engagement with pin 92*a* to move the horizontal interlock pins 92 in each column into blocking engagement with the keys 40. A partial horizontal row can be locked out by interrupting the movement of pins 92 by moving interlock bar 90 to align spring sockets 97 with the pins 92. The horizontal lock is particularly useful in accommodating more unusual election requirements. The operation of cam shaft 103** is controlled by the election judge.

Figure 9:
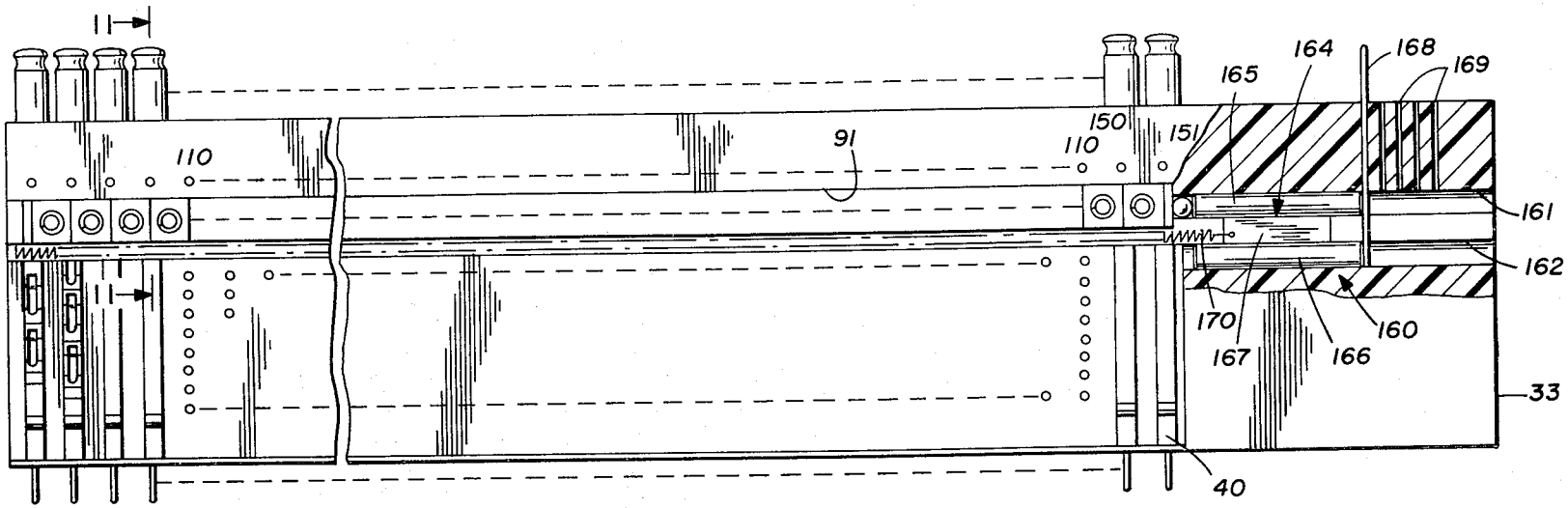
FIGS. 9 and 10 are opposite side elevational views of the individual voting machine columns, FIG. 10 being inverted.
Figure 10:
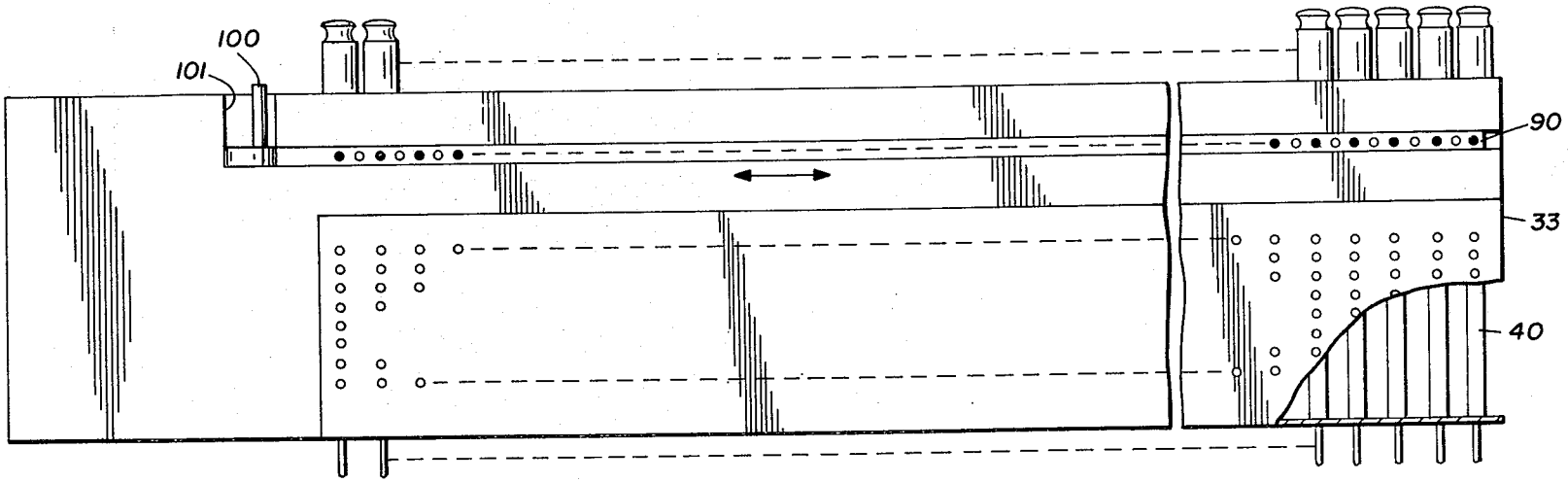
Figure 14:
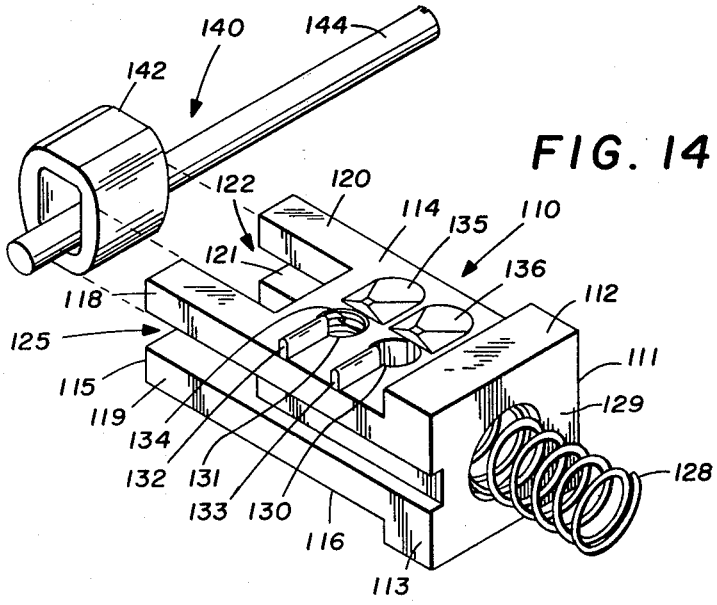
FIG. 14 is a top perspective view of a ball housing block and cam.
Figure 15:
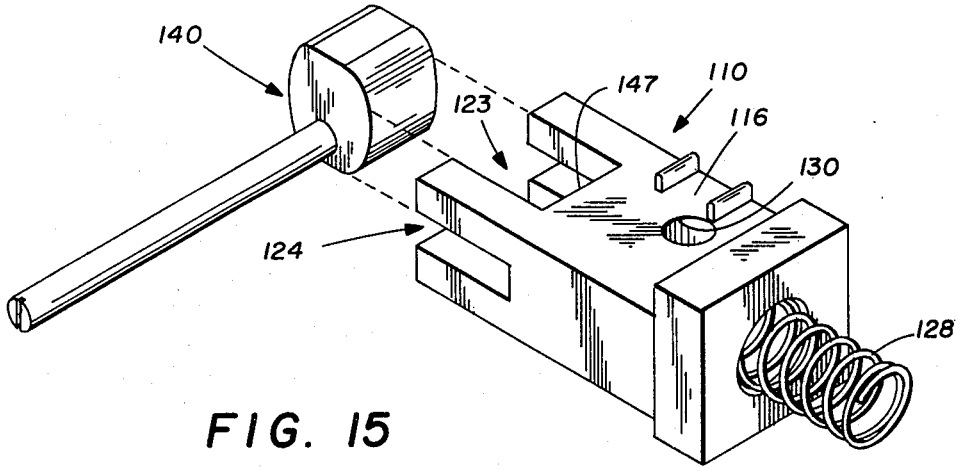
FIG. 15 is a bottom perspective view of the ball housing block of FIG. 14.
Figure 16:
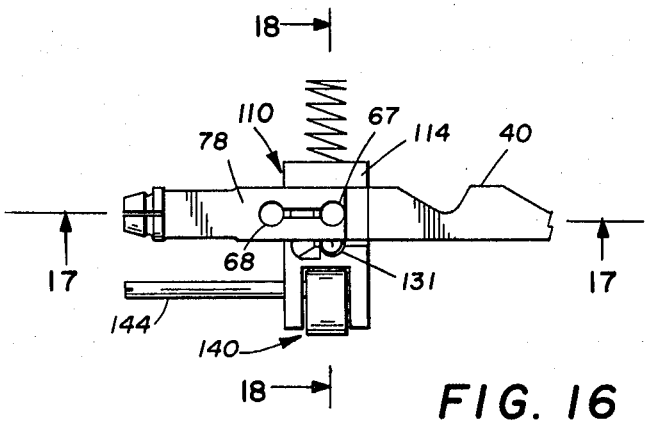
FIG. 16 is a partial detail view showing the relationship of a key overlying a ball housing block.
Figure 17:
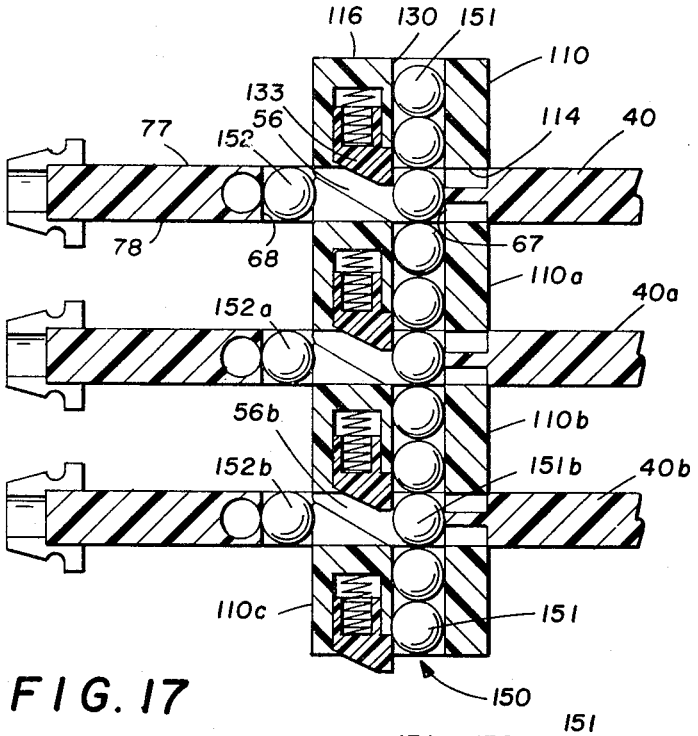
FIG. 17 is a sectional veiw taken along lines 17—17 of FIG. 16.
Figure 18:
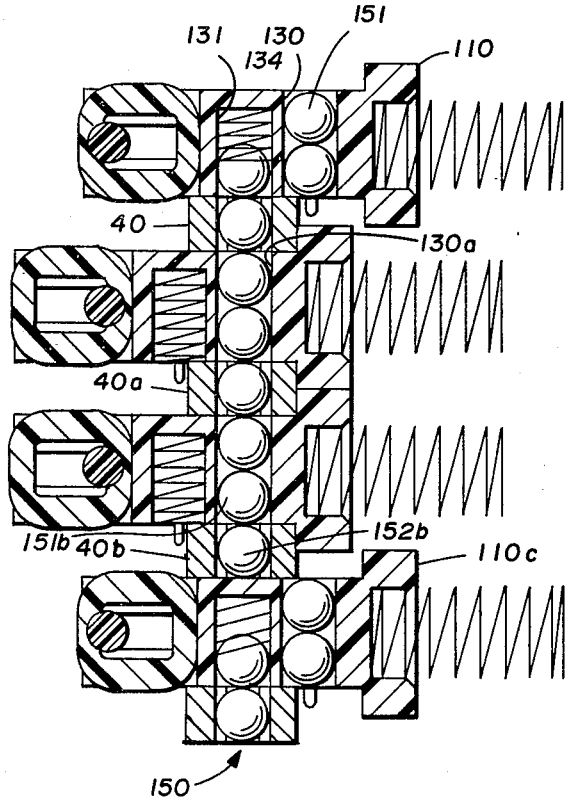
FIG. 18 is a sectional view taken along lines 18—18 of FIG. 16.

The present invention also has provision for selectively interlocking the voter selections in a vertical column and for establishing subcolumns or groups. As seen in FIG. 9, a series of ball housing blocks 110 are received in channel 91 and form part of a vertical interlock system that limits the selections that can be made in a column. Blocks 110 are alternately interposed between adjacent key slides 40. The construction of the individual ball housing 110 is best seen in FIGS. 14 and 15.

Each block 110 consists of a main body portion 111 which is generally rectangular having flanged portions 112 and 113 extending at right angles from top surface 114 and bottom surface 116, respectively. Flanges 112 and 113 are each of a depth approximately ½ of the width of the keys 40. A slot 115 extends along one side of the block to receive a corresponding transverse flange in column channel 91 to serve as a guide for lateral adjustment of blocks 110. Projecting from the back of block 110 are legs 118, 119, 120 and 121. A U-shaped opening 122 is defined between upper legs 118 and 120 and a similar opening 123 is defined between legs 119 and 121. Transverse slots 124 and 125 extend in the opposite sides of the block between the upper and lower legs.

Biasing spring 128 extends from the center of the front face 129 of the block. A bore 130 vertically extends between top side 114 and bottom 116 of the block. Spaced from bore 130 is a socket or blind bore 131. Bore 130 and blind bore 131 are of the same diameter. Socket 131 houses a biasing spring 134 which is compressible to accept a single interlock ball. Parallel guide members 132 and 133 at one edge of surface 114 are respectively aligned with the center of bores 130 and 131. At the other edge adjacent the bores 130 and 131, keeper members 135 and 136 are biased outwardly by virtue of a spring, not seen, acting within a receiving bore in the block. Keepers 135 and 136 serve to maintain alignment in the row of interlock balls as will be more fully appreciated.

Slots 124 and 125 at the end of cam housing block 110 receive cam member 140 which carries cam 142. Eccentric actuator shaft 144 adapts the cam for manual actuation. As seen in FIG. 11, cam 140 is positioned with shaft 144 supported in slot 124 and 125 so that cam member 142 abuts block end 147. Shaft 144 extends parallel to the keys 40 in holes 146 in each of the columns. Cam 140 is adjustable by insertion of a tool into hole 146 to rotate the cam through shaft 144.

Ball housing blocks 110 are sequentially arranged and oriented in the columns so that face 114 of a block 110 abuts surface 77 of a key slide 40 and opposite surface 78 engages the surface 116 of the next adjacent block 110 with the longitudinal axis of slide 40 transverse to block 110. Spring 128 extending from the ball housing blocks engages side wall 89 of the next column to bias the blocks into channel 105. Thus, it will be observed that block 110 can laterally be displaced by rotation of shaft 144, causing cam 142 to bear against surface 147 moving the block against the force of biasing spring 128.

In the normal position, blocks 110 are oriented with hole 67 of key slide 40 in line with bore 130 of the cam blocks 110. Projection 133 on the side 114 of the adjacent ball housing block 110 aligns with slot 70 on the surface 77 of the key slide 40. Thus, in the assembled position, there is a pattern as disclosed in FIGS. 16 to 18 with a continuous column or tool line 150 assembled with identical steel balls 151 extending vertically through the column. The outer hole 68 in each key slide 40 also contains a steel ball 152 identical to balls 151 contained within the tool line 150.

By laterally displacing a ball housing block 110 relative to the associated key 40, a column can be divided into several subcolumns. As is the case in many primary elections, a single candidate is to be selected from a number of primary candidates. One voting key slide 40 would be associated with each of the candidates for the particular office. A subcolumn would be indexed by moving the cam block 110 adjacent the keys defining the group in the subcolumn to a blocking position relative to the associated key slide 40. For example, looking at FIGS. 17 and 18, upper and lower blocks 110 and 110*c* have been moved to separate a subcolumn of candidates for a particular office. To accomplish this, cam shaft 144 was rotated 180° by an appropriate tool causing cam member 142 to bear against surface 147 of the cam block and urge the block against the bias of spring 128 to the position relative to the respective keys shown in FIG. 18. In this blocking position, socket 130 of ball housing block 110 and 110*c* now align with tool line 150. This establishes a three candidate subgroup with a voter being able to select one of the three keys 40, 40*a* and 40*b*.

To understand what occurs when a key in a subcolumn is voted, assume that the voter has made a selection on the voting machine causing key slide 40*b* to be depressed. As the key slide 40*b* is moved inwardly, ball 151*b* in hole 67*b* of key slide 40*b* will be forced or cammed upwardly by cam 56*b* into bore 130*b* of the next upper adjacent ball housing block 110*a*. When the key 40*b* is fully depressed ball 152*b* will have been introduced into the tool line 150 causing the tool line to advance upwardly by one ball diameter against the action of spring 134 in socket 131 in the upper terminal ball housing block 110. Spring 134 in the terminal ball housing block will not allow the tool line to advance more than one diameter into the socket 131, so that it is impossible for more than one additional ball to be introduced into the tool line. Ball 152*b* in bore 68*b* of the key slide will now occupy a position in the tool line. Should the voter attempt to actuate another key slide, such actuation will be resisted as there is not room in the tool line for any additional balls, hence only one key can be moved in each series or subcolumn.

If it is desired to vote for more than one candidate out of a series, as for example in an election for city council, the upper end of the columns are used to index a subcolumn. Referring to FIG. 9, a receiver assembly 160 is provided to permit multiple selections to be made. A number of adjacent ball housing blocks corresponding to the number of candidates are positioned having their bores 67 in alignment so that a continuous column of balls extends in the tool line. Receiver passageway 161 aligns with bores 67. A guide passageway 162 extends in the column parallel to the receiver passageway. A slider 164 has a tubular stop 165 in passage 161 and tubular guide member 166 in passage 162. Web 166 interconnects the tubular members. The inner end of stop 165 engages the uppermost ball in tool line 150. Slider 164 is spring biased by spring 170. Adjusting pin 168 abuts the upper end of slide 164. Pin 168 is inserted into vertically spaced grouping holes 169. By vertically adjusting the position of pin 168, the effective length of the tool line can be changed so that a predetermined number of balls can be introduced into the tool line. For example, if it is desired that three candidates be selected from the series, pin 168 is moved upwardly a corresponding number of grouping holes 169 to permit slider 164 to be displaced upwardly to admit three additional balls 151 into tool line 150. As explained above, each time the voter depresses the voting key, the action of the associated cam surface 56 will cause an additional ball to be moved into the tool line. When three candidates have been voted, a continuous column of balls will be formed in the tool line extending between the lower terminal ball housing block and slider 164 of the receiver 160. No additional selector keys can be depressed as they will be opposed by a solid chain of balls. It will be noted that the arrangement of the present invention has several advantages in that if a voter changes his mind he may simply pull the voting key out of its original position which will effectively remove one ball from the tool line thus permitting another selection to be made. Similarly, since the actuation of any one key in the series does not block the tool line at that position, the selections do not have to be made in any order. That is, the voter does not or is not required to vote for a number of candidates in ascending or descending order as was necessary with certain prior art types of vertical interlocks.

Clutch drive system 50 of the voting machine controls the registering operation of the machine and clears or depresses predetermined voting keys in accordance with the operational mode. Functionally, the drive system cooperates with the keys in the individual voting columns to perform the following functional operation:

1. Prevents actuation of the main voting button until at least one key in any of the columns has been depressed;
2. Automatically depresses all the keys under a party heading if the voter selects a straight party ticket;
3. Clears all previously depressed selector keys when a straight party button is actuated;
4. Automatically locks all voting keys and all remaining straight party buttons during a straight party voting cycle;
5. Clears all voting keys on the machine and restores them to an up position at the completion of the voting cycle;
6. Automatically locks out all voting keys in the machine after the completion of each voting cycle;
7. Provides a key controlled lock to be operated by the election judge to release all buttons to prepare the machine for the next voter; and
8. Permits selected columns or partial columns to be completely locked out by the election judge in accordance with the requirements of the particular ballot.

The mechanism of the main drive system 50 will best be understood by understanding operational sequence of events that occur in the voting cycle. When inactive, before the beginning of an operational voting cycle, the voting machine is in a locked condition which does not permit operation by a voter until the machine is placed in a ready condition by an appropriate election official or judge outside the voting booth.

All the voting keys are locked in an up position by means of the clear mechanism, a bar which extends the full length of each vertical column and engages each of the voting keys. The clear bar, as will be explained in more detail hereafter, is actuated by a clutch mechanism in drive 50. The bar and clutch assemblies are locked at the end of each voting cycle and are held in the up position by a common stop which can be released only by an election officail using an appropriate key in lock 26 at the side of the machine.

In addition, each individual bar and clutch assembly can be locked by a selective lockout device also actuable by an election judge using an appropriate key. These individual controls can be set to the requirements of the individual election before the election official moves the master control from a locked to voting position.

The return or clear bars remain in the up locked position until the voter presses at least one button on the panel making a voting selection. This operation depresses the clear bar in the column in which the selection is made. The main voting mechanism is locked mechanically until one of the clear bars is depressed by the voter making one selection. The main vote button 44 can then be depressed to register the voter's selections on the counters and punch card in the machine. Thus it will be seen that the clear bar performs multiple functional operations to insure the integrity and security of the voting operation performed on the voting machine.

Figure 36:
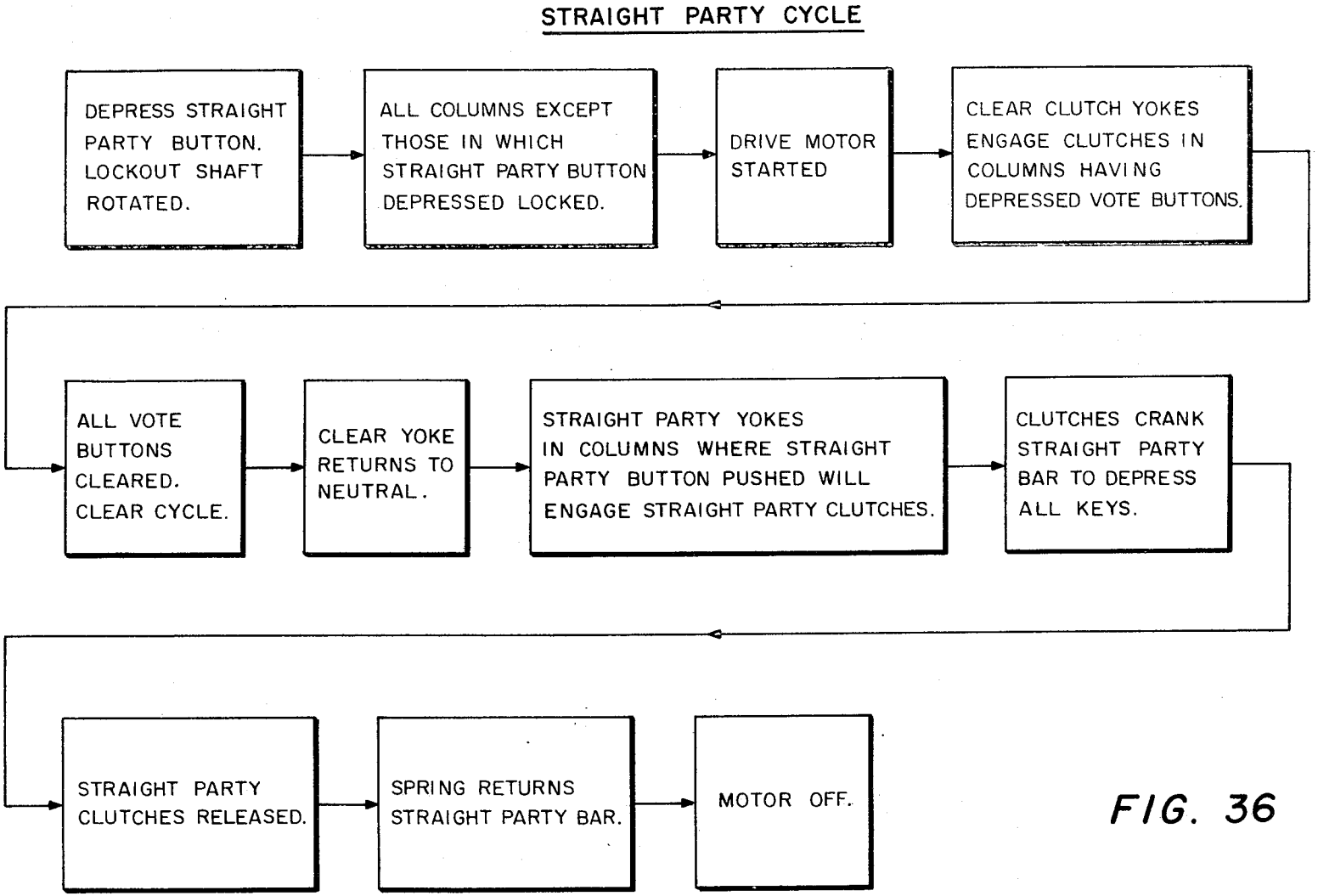
FIG. 36 is a flow chart representation of the straight party cycle.

The sequence of events outlined above are illustrated in FIG. 36 which is a system operation flow chart of the clear cycle. It will be seen from this flow chart that the drive mechanism 50 operates to lock the machine at the beginning and at the completion of the voting cycle. Further, the main vote buttonn button not cleared until at least one voter selection is made on the voting panel. After the voter's selections have been properly registered on the counters and punch card in the machine, the clear bar will return all voting keys to their normal up position.

Figure 24:
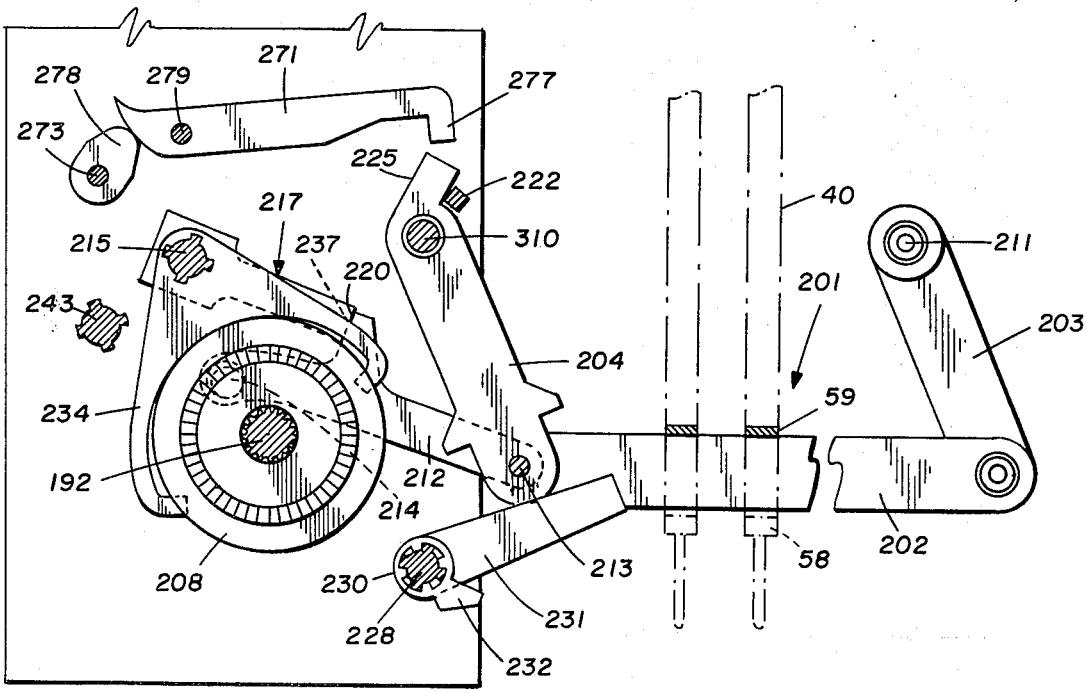
FIG. 24 is a view similar to FIG. 23 but with the mechanism shown in a voted position.
Figure 28:
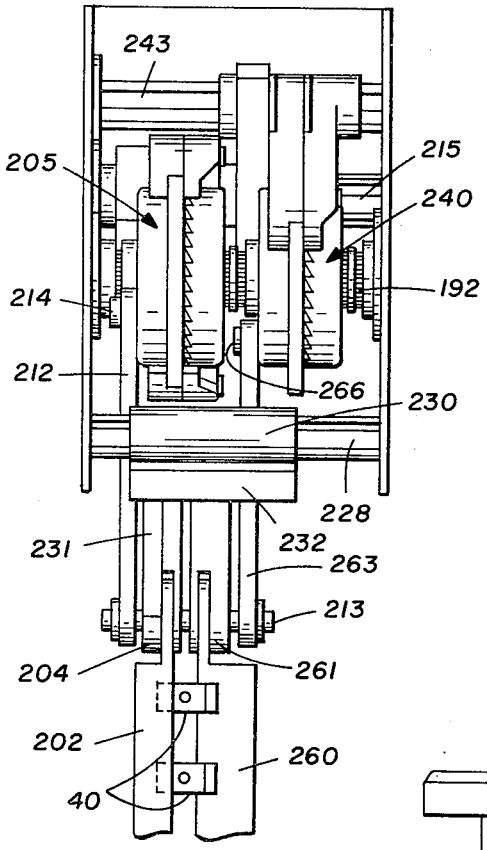
FIG. 28 is a sectional view of a portion of the column assembly as seen along lines 28—28 of FIG. 19.

The drive and clear bar mechanism is best seen in FIGS. 19, 24 and 28. The mechanism is essentially the same for each of the columns and therefore description as applied to one column will apply equally to all. The drive mechanism 50 is located at the upper end of the columns 31 to 38. A series of vertical frame elements 193 separates the mechanisms of the individual columns. Electric drive motor 45 is secured to frame element 193 associated with right hand column 38. The output of the electric motor is connected by suitable gearing 191 to main clutch shaft 192 which extends through frame elements 193 horizontally across the width of the column assembly. Carried on the main clutch shaft 192 at each column is a clear clutch 205 which has driver gear member 206 splined to shaft. Spaced apart from clutch driver 206 is driven member 208. Clutch members 206 and 208 have teeth adapted for engagement. Member 208 is biased away from member 206 by a spring, not shown, intermediate the clutch members 206 and 208. Driven clutch member 208 is not keyed to main drive shaft 192 so that shaft 192 is free to turn within member 208 when clutch 205 is disengaged. A peripheral flange 210 extends from clutch driven member 208. Parallel to the main drive shaft 192 and extending laterally to the columns through frame elements 193 is clear clutch yoke shaft 215. One end of the yoke shaft 215 engages cam surface 216 on main cam 194. Yoke member 217 is secured to shaft 215 at each of the columns to engage flange 210 of clear clutch member 208. As seen in FIGS. 19 to 21, yoke 217 has a collar 226 with arms 234 and 235 oppositely extending in a general "*c*" shape. The ends of arms 234 and 235 are notched at 236 accept the flange 210 on the driver clutch member 208. Arm 235 is provided with an internal stepped bore which carries pin 237 which is normally biased to the extended position shown in FIG. 20 by a spring. The outer end of pin 237 extends beyond the terminal end of arms 235 and when force is applied to the end, the pin will be caused to move into engagement with shaft 215. Thus shaft 215 is free to move laterally within collar 226, until locking engagement occurs by virtue of inward displacement of locking pin 237.

Lateral leftward movement of yoke 217 with shaft 215 will bring clutch members 206 and 208 into engagement to clear the keys in that column when a voting button has been depressed. Yoke shaft 215 is biased toward cam 194 by springs, not shown, and will follow cam 194 and will laterally shift in accordance with the rotative position of the cam surface 216.

Figure 25:
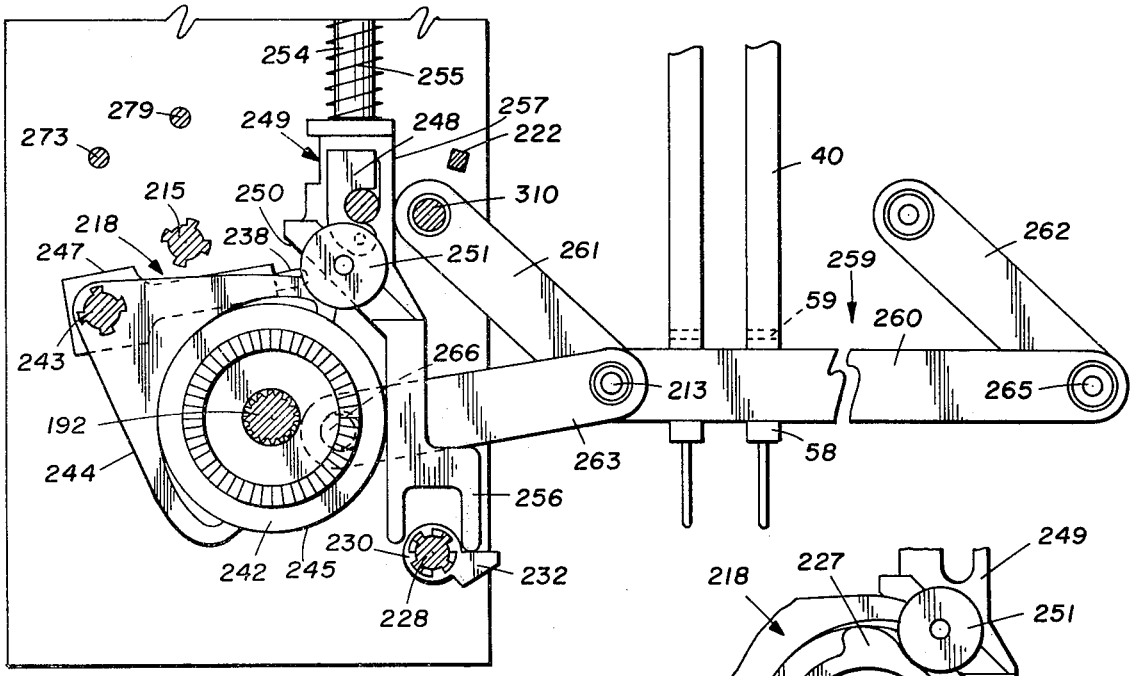
FIG. 25 is a sectional view taken along lines 25—25 of FIG. 19 with the straight party mechanism in a non-voted position.
Figure 27:
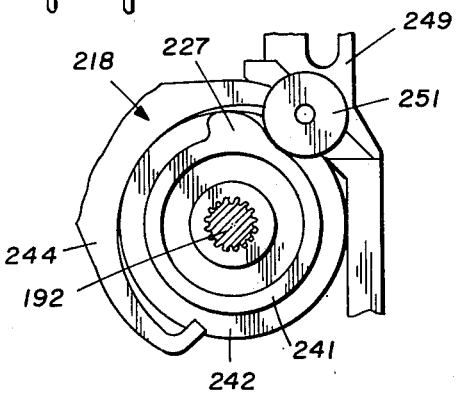
FIG. 27 is a detail view of a part of the straight party mechanism.
Figure 26:
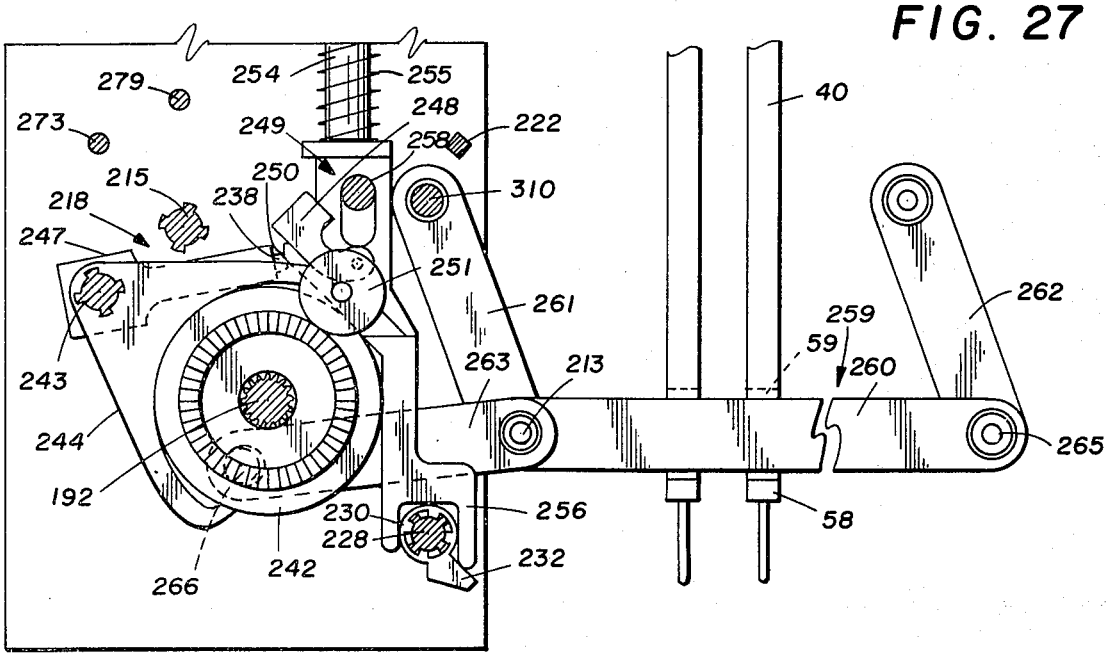
FIG. 26 is a view similar to FIG. 25 but with the straight party mechanism in a voted position.

The clear bar 202 is part of a four bar parallel linkage generally indicated 201 that extends the length of each column adjacent shoulder 59 on the lower end of keys 40. The lower end of the clear bar is privotally connected to link 203 which in turn pivots about shaft 211 which extends laterally across the columns and is secured to the frame elements 193. The opposite end of the clear bar adjacent the drive mechanism is pivotally connected to link 204 at pivot 213. A crank 212 extends from pivot point 213 on the four bar linkage to a stub shaft 214 extending from the face of driven clutch member 208 opposite the gear teeth. Abutment 220 is carried on crank 212 and is adapted to be rotatively moved into engagement with yoke pin 237 upon depression of a key 40 as seen in FIG. 24. This operation locks yoke 217 to shaft 215 and is shown in FIG. 25. The operational sequence of the clearing operation will be described in more detail hereafter.

Figure 29:
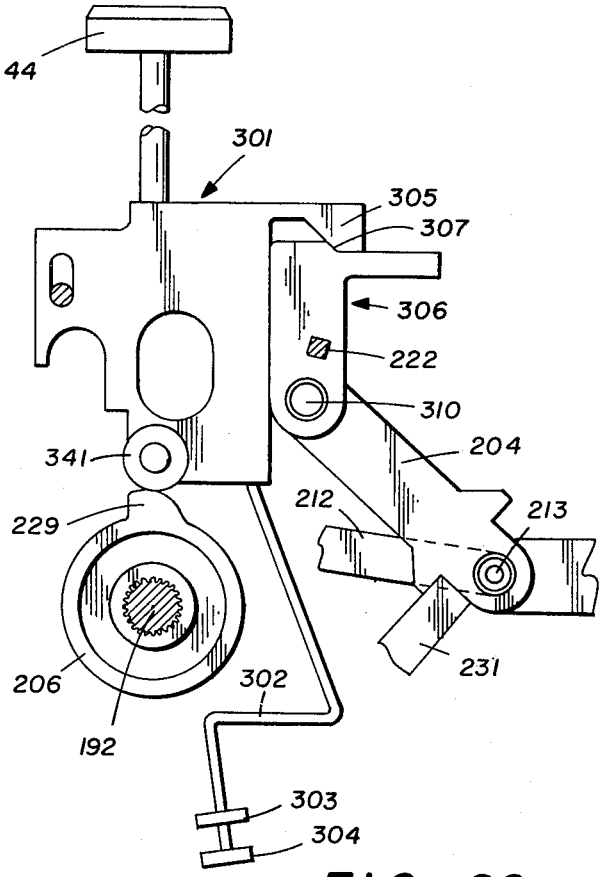
FIG. 29 is a partial sectional view taken along lines 29—29 of FIG. 19.
Figure 30:
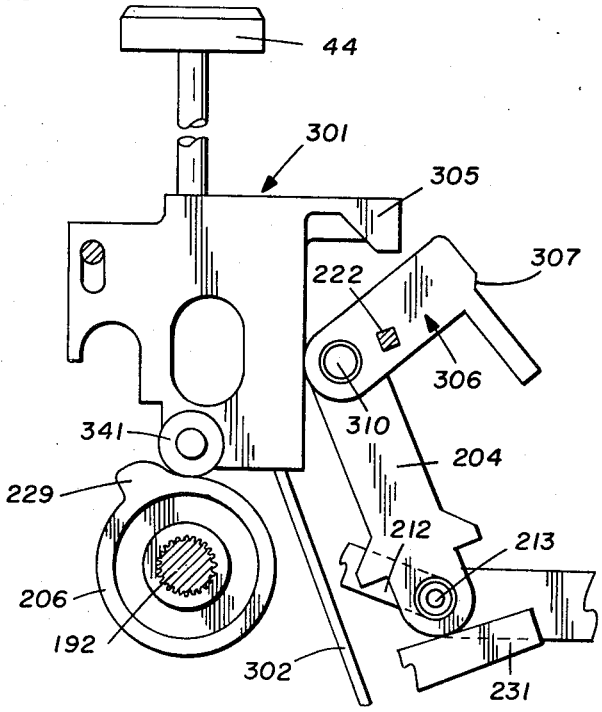
FIG. 30 is a view similar to FIG. 29 but with the main voting button mechanism shown in an alternate position.

Referring also to FIGS 29 and 30, main vote button 44 which serves to energize the drive motor 45 upon completion of voting selection has a member 31 that extends into the drive 50 in column 38. When member 301 is blocked the main voting button cannot be depressed and the voting cycle cannot be initiated. An abutment member 306 physically engages section 305 of the member 301 to prevent actuation except when a voter selection has been made in one of the columns on the machine. Abutment 306 is connected to pivotal square shaft 222. Shaft 222 extends laterally across the columns pivotally engaging crank arms 204, as seen in FIG. 24 at shoulder 225 formed at the upper end of crank 204. After the machine has been cleared and prior to any voting operation, all of the clear bars 202 will be in the up position as will all the voting keys as seen in FIG. 29. Upon the making of a selection at any column, the associated clear bar 202 in that column will be forced downwardly by shoulder 59 on key slide 40 causing crank 204 in that column to accordingly pivot to the position seen in FIG. 30. The pivoting action of the crank will impart a slight rotation to square shaft 222 through shoulder 225 to cause shaft 222 and member 306 to be swung out of its interfering position with member 301 of the voting key, leaving the voting key free to be depressed. If the voter should try to actuate the main voting button prior to making a selection, it will be obvious that the machine cannot be activated and nothing will happen. This insures that the voter cannot disenfranchise himself by operating the machine through a voting cycle without having actually made one or more voting selections.

Figure 23:
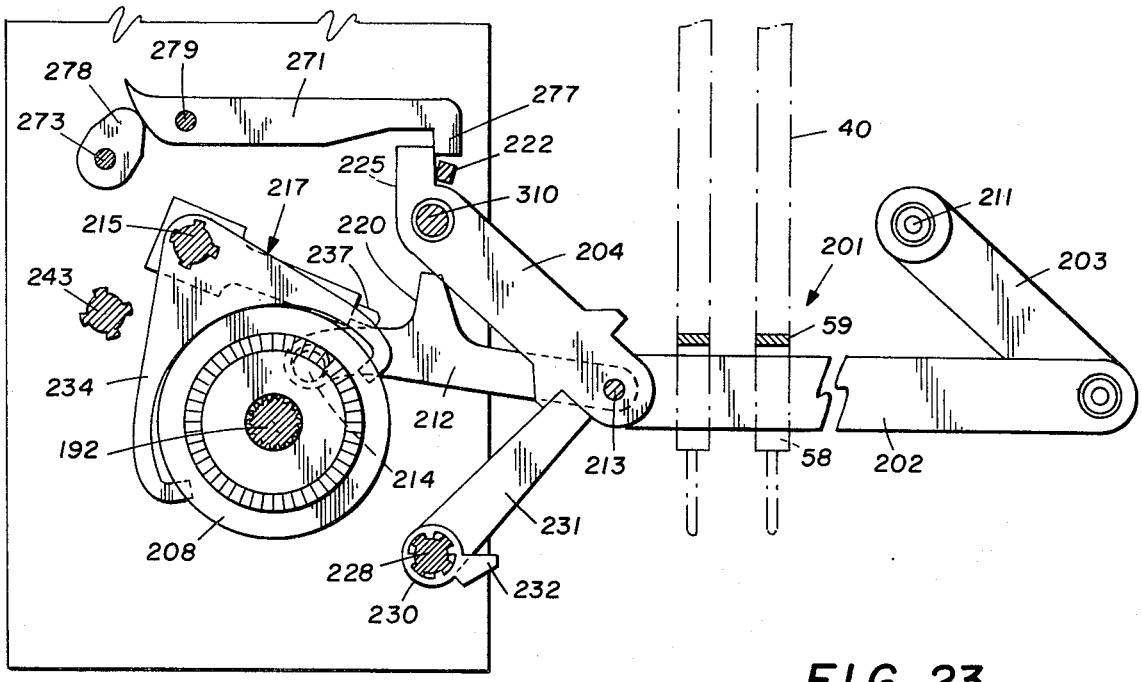
FIG. 23 is a sectional view taken along lines 23—23 of FIG. 19 with the mechanism shown in a locked position.

Referring again to FIGS. 19 and 23 and 24, all of the voting columns are locked in a nonoperational condition at the completion of the voting cycle by means of lockout shaft 228 which extends transversely across the columns through frame elements 193 in a location below the main drive shaft 192. A lockout pawl 230 having a pawl arm 231 and flange 232 is provided in each of the columns. The pawl arm 231 pivots with shaft 228 from an unlocked position below crank 212, as seen in FIG. 24, to a locked position, as seen in FIG. 23, with the end of pawl arm 231 bearing against the underside of crank 204. It will be obvious that in this latter position, pawl arm 231 will prevent movement of clear bar 202 by the depression of a voting key. Therefore, pawl 230 serves through clear bar 202 to lock the voting keys in a nonactuated position. Pawl shaft 228 is connected through appropriate gearing and cable 319 to lock 26 on the side of the machine. After the completion of the voting cycle, the lockout shaft is rotated in a locked position by the election official by means of lock 26, thereby preventing depression of any of the column keys. To prepare the machine for the next voter, an election judge or official would simply insert a key into locking mechanism 26 and rotate it to an unlocked position which will rotate lockout shaft 228 and pawl arm 231 to an unlocked position in preparation for the next voter.

Figure 35:
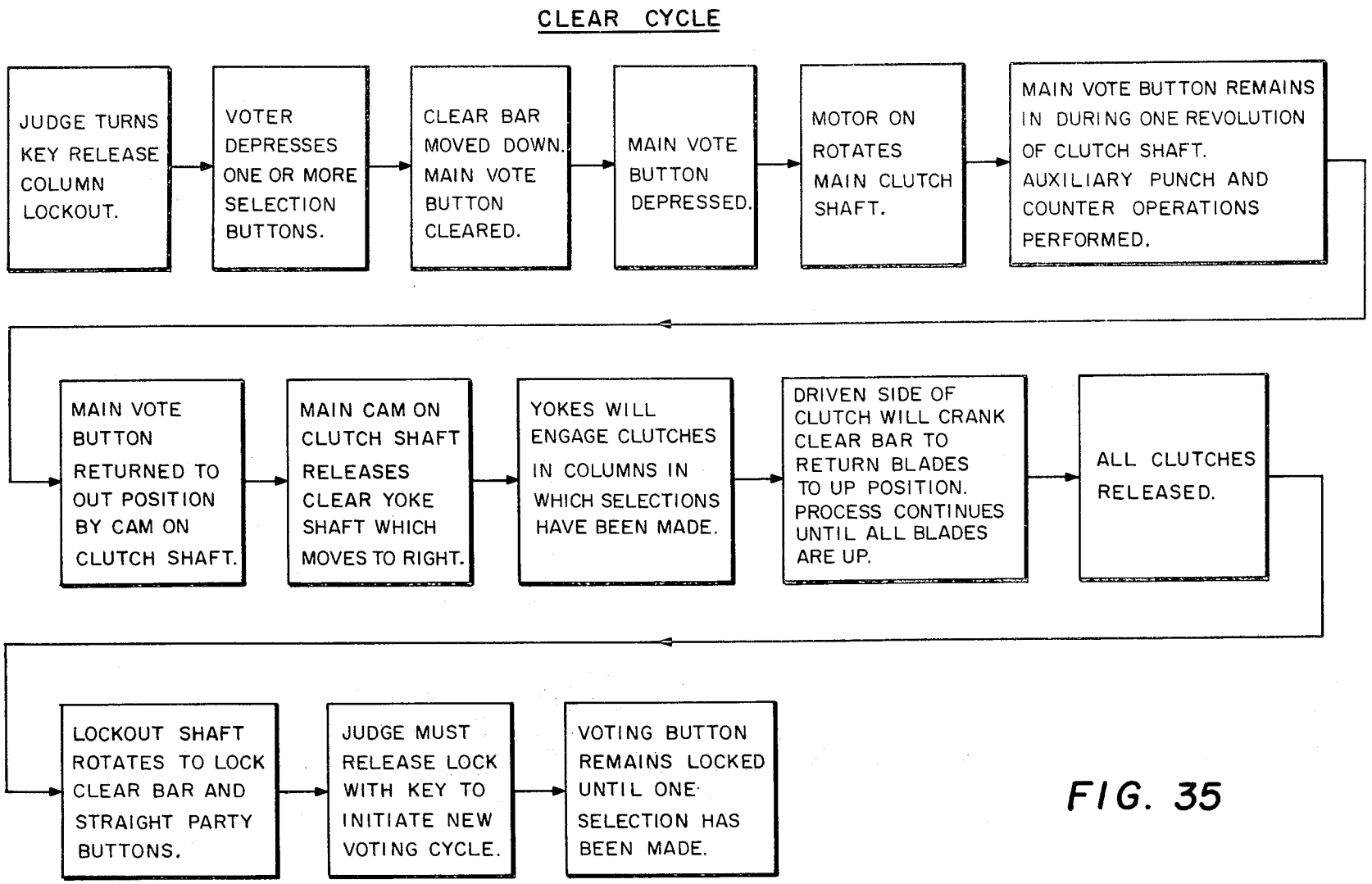
FIG. 35 is a flow chart representation of the clear cycle operation.

Looking at the system operation flow chart shown in FIG. 35 as well as FIGS. 19 to 24 and 29 and 30 which show in detail the clear mechanisms described above, the operation of the voting machine through the clearing cycle would be as follows: Several operations must be performed prior to placing the machine in an operational condition. The voting official or attendant will insert a key in lock 26 and rotate the key to move from a locked vote condition. This will cause lockout shaft 228 to rotate lockout pawl arms 231 out of engagement with the underside of cranks 212 on the columns. The voter must now insert a data processing ballot card in the slot 25 in the upper right hand of the machine. Proper positioning of the card releases an interfering solenoid armature that prevent depression of the main voting key. The machine is in the ready condition for the voter to make his selections. The voter proceeds with voting operations, making the desired selections by pushing down selected buttons which will cause the corresponding key slides 40 to be depressed. Once the first selection is made by the voter, the corresponding key 40 by virtue of shoulder 59 will displace clear bar 202 in the column in which the selection is made downwardly causing square lockout bar 222 to rotate abutment 306 out of an interfering position with abutment 305 of main voting button member 301. Thus, at any time after a single selection has been made, the voting cycle can be initiated by the voter pushing the main button 44. The voter continues to make the selections of his choice with the column interlock system described above preventing a voter from overvoting. Ater the voter has completed his selections and is satisfied with his choices, he presses the vote button 44 and the machine punches the data card and registers the votes on the tally counters simultaneously. In those columns in which voter choices were made, the yoke 217 is engaged with shaft 215 by virtue of pin 237 abutting shoulder 220 of crank 212. Drive motor 45 rotates main shaft 192 and associated main cam 194 to a position where clear clutch yoke shaft 215 is cammed to cause clear clutch member 208 to contact member 206 to cause the clear clutch 205 to engage. Rotation of the main drive shaft 192 will be imparted through driven member 208 and crank 212 to the clear bar 202 of the four bar linkage to return the keys 40 to an up position by engagement at shoulder 59. At the completion of the clear cycle and rotation of the clutch members, the cam surface on main cam 194 will drive the yoke shaft to its nonactuated position opening clear clutch 205. At this point the vote cycle is completed, all the voting buttons having returned to their up position with the tally counters and data card properly registered. Rotation of clutch member 206 will bring cam lobe 229 into contact with cam surface 302 on main voting member 301 to return the main vote button 44 to an up position.

Figure 32:
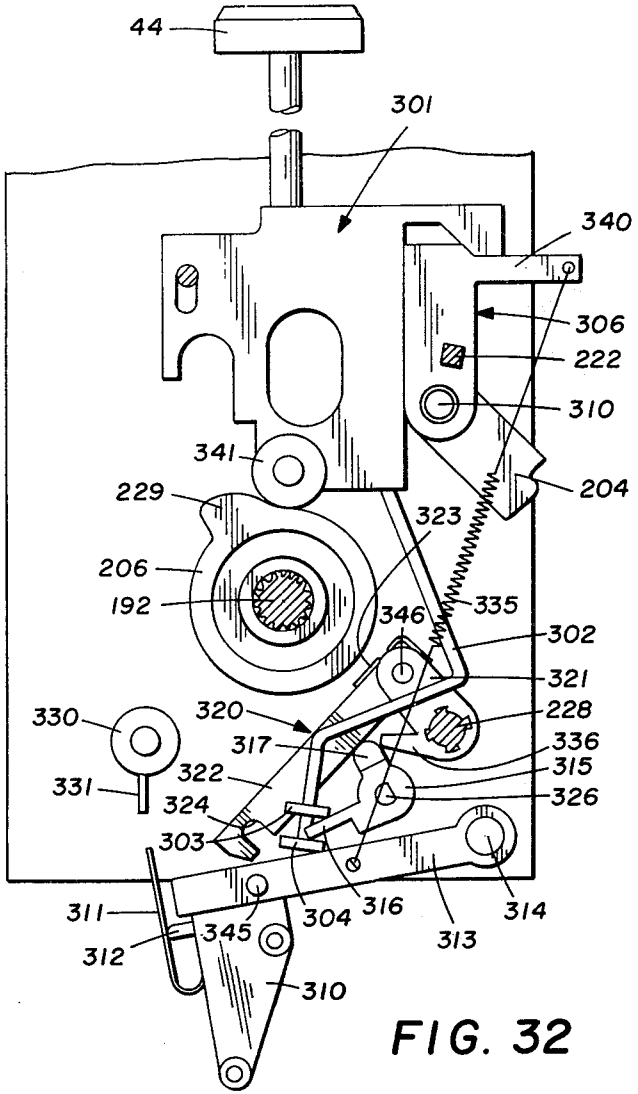
FIG. 32 is a view similar to FIG. 31 showing the motor control switch in an actuated position.
Figure 31:
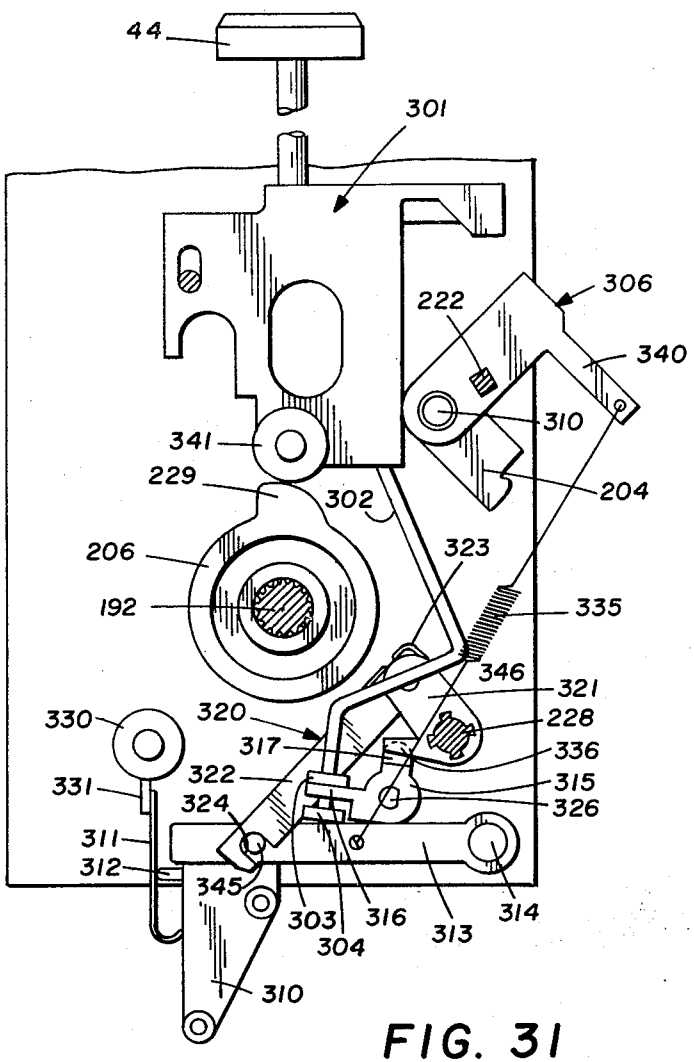
FIG. 31 is a partial sectional view generally taken along lines 25—25 of FIG. 19 with structure removed to more clearly illustrate the motor control switch.

FIGS. 31 and 32 are views similar to FIGS. 29 and 30 and additionally show the components for actuation of the motor by switch 310 which is in the motor control circuit, not shown, when vote button 44 is depressed. Switch 310 is a normally closed micro-switch actuable to an open position by lever 311 acting to depress plunger 312. Switch 310 is mounted on the end of switch arm 313 which is pivotal about shaft 314. Member 330 carries abutment 331 which is adapted to engage lever 311 when arm 313 is in the horizontal position. Locking pin 345 projects from switch arm 313. Arm 313 is connected to arm 340 of member 306 by tension spring 335. Pawl 315 has arms 316 and 317 and is rotatable about shaft 326. Locking member 320 includes arm 322 having a notch 324 near its terminal end and pawl 321 rotative about shaft 228. Pawl 321 is provided with flange 336. Pawl arm 321 and arm 322 are joined to common pivot 346. The arms are urged to the relative positions shown in FIG. 31 by torsion spring 323 located at pivot 346. Actuating arm 302 of vote button body member 301 is configured to project adjacent switch 310 having foot 304 engaging lever 313 and foot member 303 engaging arm 316 in a nonactuated position.

FIG. 31 shows the motor switch 310 in a nonactuated position. Member 306 has been pivoted downwardly by square shaft 222 by virtue of one or more voting selections having been made. At the completion of the voting cycle, button 44 is depressed which through member 304 pivots arm 313 downwardly about shaft 314. Locking arm 322 is disengaged from pin 345 by pawl arm 317 which is rotated into position engaging the underside of arm 322 by foot member 303. The movement of arm 313 disengages switch lever 311 from abutment 331 permitting plunger 312 to release to close the switch 310 energizing motor 45 to actuate the drive mechanism 50 through the clear cycle as described above.

Upon completion of the clear cycle, member 301 and button 44 are returned to the up position by cam 229 which engages roller 341. Clearing of the machine will move link 204 to cause member 306 to be returned to its vertical position as seen in FIG. 32 tensioning spring 335. Spring 335, in a tensioned condition, will exert sufficient form to return arm 313 into a non-actuated position with lever 311 engaged at abutment 331 with pin 345 in notch 303. Should any column not be cleared, as for example due to the non-engagement of a clear clutch 205, member 306 will not be returned to the vertical position; spring 335 is not tensioned in this position of member 306 and switch arm 313 will remain in the down, switch-on position until all columns are cleared and member 306 returns to the vertical position.

It will be understood that drive motor 45 can be used to power the punch operation prior to the initiation of the clearing cycle. In such case the clearing operation is not commenced until these tallying operations are completed. This may be accomplished by appropriately configuring cam surface 216.

At the completion of the clearing cycle lockout shaft 228 will rotate to bring pawl arms 231 into engagement with cranks 212. The voting cycle is completed and the machine is in a locked condition with clear bar 202 engaging the shoulders 59 on key slides 40 thereby interfering with the downward actuation of any of the voting keys until the machine is released by an official.

The present voting machine also has provision for straight party voting. Referring back to FIG. 1, it will be seen that a button designated by numeral 21 is provided at the top of each column. This button initiates the straight party cycle. If the voter in a general election wishes to vote for all of the candidates of a single party, he depresses the straight party button in the appropriate column. For example, depression of key 21 at the top of column 18*c* as seen in FIG. 1 would initiate the automatic cycle of operations shown in FIG. 36 which depresses all the vote buttons in a selected column causing a vote to be case for each of the Republican candidates. The energization of the motor circuit will be described later.

Referring to FIGS. 19, 25, 26 and 28, straight party yoke shaft 243 extends laterally across the columns the drive unit adjacent clear clutch shaft 215. Straight party clutch assembly 240 is mounted on main clutch shaft 192 adjacent the clear clutches 205. Straight party clutch assembly 240 incudes driver member 241 having teeth on one face. Driven clutch member 242 is adjacent member 241 and has teeth oppositely arranged to cooperate with the teeth on clutch member 241. Driven member 242 is engaged by yoke 218 mounted on yoke shaft 243. Yoke 218 is similar to yoke 217 and has a pair of oppositely extending arms 244 which are notched to receive annular flange 245 of member 242. Moveable pin 238 extends in pin block 247 having an outer end adapted to depress the pin inwardly. The inner end of pin 237 is adapted to contact shaft 243 when the outer end is depressed to engage yoke 218 and yoke shaft 243. Pin 238 is depressed by the action of the straight party button 21. The straight party clutch components are identical in structure to the clear clutch components shown in FIGS. 20–22, to which reference may be made.

Straight party button 21 includes assembly 249 having elongated shaft portion 254 extending into the drive 50 connected to a body member 255 adjacent the straight party yoke 218. Roller cam 251 is carried on body 257 and aligned to engage pin 238 when depressed. Foot member 256 extends from member 257 in alignment with flange 232 of pawl 230. A keeper 248 is spring biased to a position engaging shaft 258 as seen in FIG. 25. A compression spring 255 exerts a downward force on assembly 244 resisted by the engagement of keeper 248 at shaft 258. Depression of straight party button 21 will, by virtue of a linkage not shown for clarity, pivot keeper 248 out of engagement with shaft 258. Spring 255 will drive assembly 249 downwardly so that cam 251 contacts pin 238 and foot 256 engages pawl flange 232.

The straight party cycle is effectuated by means of another four bar mechanical linkage generally designated 259. A straight party linkage bar 260 is disposed on the side of the voting keys opposite the clear bar immediately below projection 58 at the terminal end of the blade. Links 261 and 262 are pivotally connected to opposite ends of bar 260 at pivot points 213 and 269. A crank 263 is pivotally connected between pin connection 231 on bar 260 and clutch element 242 at stub shaft 266. It will be obvious that when straight party clutch 240 is engaged, pin connection 266 will be rotated causing straight party bar 260 to move into engagement with shoulder 58 thereby depressing all the voting keys in that column.

Figure 34:
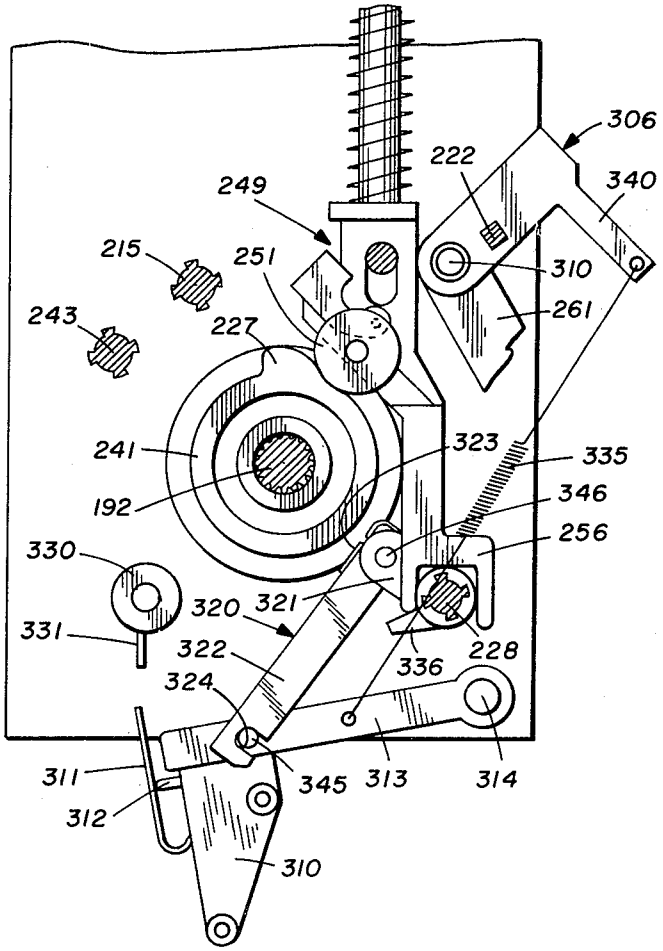
FIG. 34 is a view similar to FIG. 33 showing the switch in an actuated position.
Figure 33:
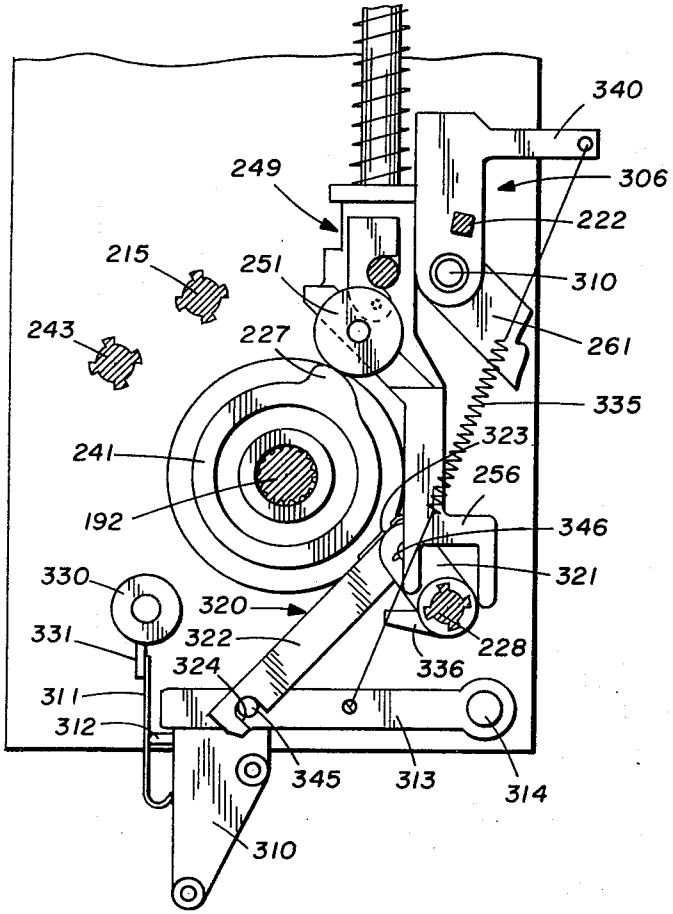
FIG. 33 is a partial sectional view generally taken along lines 25—25 of FIG. 19 with structure removed to more clearly illustrate the actuation of the motor control switch in the straight party cycle.

Actuation of the straight party button 21 initiates the following sequence of events which are represented in FIG. 36. Motor 45 is started by switch 310, as seen in FIGS. 33 and 34, which show the motor switch 310 in cooperation with member 249 of straight party button 21. The switch actuation components have been described above in detail with reference to FIGS. 31 and 32. Depression of a straight party button 21 moves extension 249 downwardly causing member 256 to engage flange 336. Locking 322 is pivoted, remaining in an engaged position at pin 345 causing switch arm 313 to move downwardly away from abutment 331 to close switch 310 and start drive motor 45. Torsion spring 323 permits member 320 to extend to follow pin 345. The machine is first cleared. Main cam 194, which controls the sequence of operation, cams the clear clutch yoke shaft 215 so that the clear clutches 205 in the columns in which any individual selections have been previously made are cleared by means of the clear bar linkage 201. The clear cycle is necessary to return any other selections to a non-voted position when a straight party ballot is indicated to prevent any cancellation or improper voting procedure. Description of the clear cycle will not be set forth in detail here as it has been discussed above. After rotation of the clear clutches, the clear yokes 217 will disengage the clutches 205 and the straight party cycle begins. Completion of one clear cycle and return of member 306 to its vertical position at the completion of the clear cycle will not, at this time, return switch arm 313 to its non-actuated position since arm 313 is held down by locking member 320. Keeper 258, in the column voted, is pivoted away from engagement with shaft 258 permitting spring 255 to drive straight party assembly 249 downwardly. Lockout pawl arm 231 will be held in a disengaged or unlocked position by end 256 of straight party assembly 249. At the same time, roller cam 251 will engage pin 238 causing yoke 218 to become keyed to shaft 243. Cam 194 at the end of the clutch shaft 192 cams straight party yoke shaft 243 so that the straight party clutches 240 clutches in the columns in which selections have been made are closed. The clutches are rotated and by means of four linkage 259 described above, the straight party bar 260 is displaced depressing all the buttons in that column against shoulder 58 of the keys. At the end of this stroke, cam surface 227 on the driver clutch 241 engages roller 251 and clears the straight party assembly 249 returning it to an up position with keeper 248 in locked engagement at shaft 258. As the straight party button is cleared the lockout pawl 230 rotates, releasing all columns and completing the cycle by returning main cam 194 to its index position. Motor 45 continues to operate until the completion of the straight party cycle, when member 249 is returned to an up position by cam 227 engaging roller 251. This permits spring 335 to return the switch arm to the non-actuated position seen in FIG. 33 and shuts off motor 45. Upon depression of the main voting button, the voter's straight party selections will be tabulated on the tally counters and punch card inserted in the machine and the clear cycle described above will be initiated. The machine will be returned to a locked position ready to accept another voter.

The voting machine of the present invention is highly adaptable to various requirements. For example, in many elections, a number of candidates or issues less than the total capability of the machine may be presented to the voter. In this case, it will be necessary to lock out the unused columns so that the voter cannot intentionally inadvertently actuate the selector buttons in the unused columns.

As seen in FIGS. 19, 23 and 24, a column lockout shaft 279 extends across the columns and is supported in frame elements 193. Lockout lever 271 is pivotally connected to shaft 279 in each of the columns. Lever 271 has latching end 277 which is adapted to engage a portion of the clear crank arm 204 at end 225 so that the clear bar is held in engagement with shoulder 59 on the individual keys preventing keys 40 from being depressed. A cam shaft 273 extends parallel to the column lockout shaft 279 and carries a cam 278 in each of the columns. Cam shaft 273 is connected by a flexible cable 318 to lock 28 on the side of the frame. Lock 28 receives a key and has multiple positions which in turn correspondingly position cam shaft 273. Cams 278 on shaft 273 are configured to engage and actuating arm of lever 271 in selected positions of cam shaft 273. Therefore by employing different positions in conjunction with multiple position key lock 28, many combinations of columns can be locked in or out of use.

The column lockout mechanism described above is particularly useful when using the voting machine for primary elections in jurisdictions where the voter must declare his party preference prior to voting. The lockouts can then be actuated to vertical columns established for the parties other than the voter's particular party. In this way, the machine can accommodate multiple primary elections with the election official on duty having only to turn key lock 28 to prevent the voter from voting for candidates in any columns than the column corresponding to the voter's party.

Again referring to FIG. 1, it will be seen that ballot column **18*i* is provided to permit the voter a write-in choice candidate. For example, if the voter wishes to cast his ballot for a write-in candidate for the office of senator, he would depress the write-in button in Column 18*i* horizontally aligned with that office. Upon completion of the voting operation after the vote button has been depressed and the voter's indication is registered on the punch card, the card would be removed from the slot. The voter can then write the names of the candidates he wishes to vote for on the ballot card itself providing a permanent record thereon in the voter's handwriting. Appropriate blanks for each office could be provided on the data card to facilitate write-in voting Generally when provision for write-in voting is made in column 38 corresponding to ballot 18*i***, the straight party mechanism may be omitted from the machine as being unnecessary.

Figure 8A:
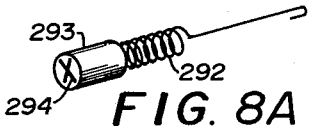
FIG. 8A is a perspective view of the button shown in FIG. 8.
Figure 8:
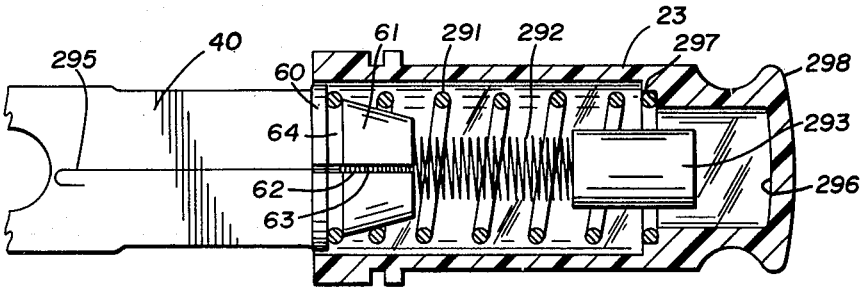
FIG. 8 is an enlarged detail view of the voting key and associated button.

Another unique feature of the present invention allows a voter to easily determine which voting he has previously selected. This is accomplished by a luminescent "X" becoming visible in the top of the voting button when the voting button is depressed. Referring to FIG. 8, it will be seen that the outer end of voting key 40 is provided with a circular flange 60 and a projecting conical section 61. Annular groove 64 extends around the base of conical section 61 adjacent flange 60. Concentric blind bore 289 extends in the outer end of conical section 61. Diametral slot 63 extends axially along conical section 61. The outer end of slide 40 is capped by vote button 23 which is generally cyclindrical shaped having its inner open end surrounding flange 60 of slide 40. A compression coil spring 291 is engaged in annular slot 61 and extends circumferentially along the interior of vote button 23 and is engaged with interior shoulder 297 of vote button. When vote button is pushed, the force will be transferred to the flange 60 of slide 40 causing vote button 40 to correspondingly be depressed. Spring 291 serves to give some resiliency to the voting operation and also serves to protect the voting machine by absorbing any shock that may be imposed on the voting button by unusual voting tactics resulting from voter frustration and anger. A smaller coil spring 292 extends axially within vote button 23 and seats on the botton of blind bore 262. Spring 292 terminates short of the end of button 23 and is provided on its outer end with a small cylindrical cap 293. Cap 293 is provided with an "X" indicator 294 on its outer surface. Cap 293 is preferably of a bright luminescent color having light gathering characteristics. In this way no special lighted or external illumination is needed for the voting button. This eliminates expensive and complicated electrical circuitry. A retainer 295 extends from the lower end of coil spring 292 in slot 63 along the shank of voting key 40. With voting key 40a in a position in a voting column, retainer wire 295 is secured to shoulder 84 in bore 39 of the column. Similarly, the exterior surface of vote button 23 is snugly fit within bore 39 in the column. Button 23 is transparent and is preferably of a clear plastic material having end surface 298 frosted to diffuse light passing through. Thus it will be seen that when the vote button is in a nonactuated position, cap 293 is positioned away from the inner end 296 of vote button 23. The "X" on the end of cap 293 is thus not visible to the voter as the light is diffused at surface 298. When a voter depresses button 23, relative movement between button 23 and cap 293 will occur causing end 296 to come into close contact with the end of cap 293. The light diffusion is reduced on the "X" on the outer end of cap 293 highly visible to the voter through the end surface 298 of the vote button. The luminescent color of cap 293 further improves the visibility of the " X" on the voted buttons. Thus, the voter can easily visually determine which button he has selected by simply locating those buttons on which the "X" is visible. Also, as a further indication to the voter, the physical displacement or depression of the button serves to indicate a voted selection.

Thus, the present invention provides a compact mechanically operated voting machine which records each voter's choice simultaneously on mechanical counters and on conventional data cards for computer completion. The voting panel is arranged similar to a conventional paper ballot providing space for candidates and issues. Vertical and horizontal interlock devices provide almost an infinite number of voting arrangements including straight ticket, split ticket, and selective voting in accordance with the requirements of almost any election or jurisdiction. Lockout devices insure the integrity and security of the voting operation. It will be noted that no one person can alter the election judge since such would require the concerted action of the judge operating the key locks, the person responsible for the tally counting, as well as tampering with the computer checked results. Such concert of action would be easily detected and therefore is not likely, adding to the security of the system. The straight party mechanism permits the voter to choose to vote a straight party ticket with ease and accuracy. It will be noted that the machine was described as being powered in the drive system by an electric motor. It will be obvious to those skilled in the art that the main drive system can be operated by means of a hand crank, for example, mechanically connected at gears 191. With this option, the voting machine of the present invention is totally mechanical permitting voting operations to be effectively carried on during periods when electric power is not available or if electric service is interrupted.

Although preferred embodiments of the invention have been described in detail, it is to be understood that various changes, substitutions, and alterations can be made therein without departing from the spirit and scope of the invention as defined by the appended claims.

What is claimed is:

1. A voting machine comprising:

a columnar frame;

a plurality of voting keys arranged in said frame moveable between a first position and a second position, said keys carrying abutment means thereon;

linkage means including a bar pivotally connected at opposite ends and engaging said abutment means and adapted for planar movement from a first position with said keys in said first position to a second position with said keys in said second position;

a drive shaft;

clutch means operatively connected by crank means to said linkage means for moving said linkage means from said first to said second position, said clutch means including a first clutch member connected to said drive shaft and having gear teeth at one face, a seocnd clutch member slidably mounted on said drive shaft and having teeth on one face adapted for mating engagement with the teeth on said first clutch member;

a yoke shaft;

yoke shaft cam means adapted to position said yoke shaft;

yoke means carried on said yoke shaft and engaging said second clutch member; and connector means for securing said yoke means to said yoke shaft with said linkage means in said first position, whereby said yoke means may be selectively secured to said yoke shaft and cammed by said cam means to engage said clutch members thereby moving said keys from said first to said second position.

2. The voting machine of claim 1 wherein said first linkage position corresponds to a key voted position and said second linkage position corresponds to a key unvoted position, and wherein said connector means comprise pin means actuable to secure said yoke means to said yoke shaft and further including abutment means carried by said crank means adapted to depress said pin means when said linkage means is moved to said first position by voter actuation of one of said voting keys to said first position whereby said clutch members are engaged to clear said machine by moving said keys to said key unvoted position following a voting operation.

3. The voting machine of claim 2 including selectively positionable pawl means having an arm engageable with said linkage means in a first locked position preventing movement of said keys from said second to said first position.

4. The voting machine of claim 3 including key actuated lock means operatively controlling the positioning of said pawl means.

5. The voting machine of claim 1 wherein said first linkage position corresponds to an unvoted key position and said second linkage position corresponds to a key voted position, and wherein said connector means comprise pin means actuable to secure said yoke means to said yoke shaft and further including voter actuable means for selectively depressing said pin means to engage said clutch members thereby moving selected aligned keys to a voted position to register a straight party vote.

6. The voting machine of claim 2 wherein said yoke shaft is parallel to said drive shaft and said yoke shaft cam means is carried on said drive shaft and said yoke shaft is biased into engagement with said cam means.

7. The voting machine of claim 5 wherein said yoke shaft is parallel to said drive shaft and said yoke shaft cam means is carried on said drive shaft and said yoke shaft is biased into engagement with said cam means.

8. The voting machine of claim 5 wherein said voter actuable means comprise a plunger having a cam surface adapted to depress said pin means.

9. The voting machine of claim 8 wherein said clutch means include cam means adapted to return said plunger to a non-actuated position at the completion of the cycle.

10. The voting machine of claim 8 wherein said plunger is spring biased to an actuated position and further and further including keeper means restraining said plunger against said bias and means for releasing said keeper upon a voter operation permitting said plunger to be actuated by virtue of said spring.

11. A voting machine comprising:

a plurality of aligned rows of voting keys arranged within a frame member, said keys being voter moveable relative to said frame from a non-voted position to make a selection;

clearing means for each of said rows of keys, said clearing means including abutment means on said keys and bar means in engagement with said abutment means and moveable with said keys and adapted to return said keys to a non-voted position;

power means for actuating said clearing means including a drive shaft common to said rows of keys;

clutch means for each row of keys including a driver clutch member connected to said common drive shaft and a driven clutch member connected to said bar means and adapted to drive said bar means;

means on each clutch means for engaging said driver clutch member with said driven clutch member to actuate said bar means to return said keys; and registering means actuable by said keys to register voter selections.

12. The voting machine of claim 11 further including voter operated main control means for actuating said registering means to register said voter selections.

13. The voting machine of claim 11 including means interlocking said clear means to said main control means whereby said main control means remain inoperable until movement of a key to said voted position clears said interlock means.

14. The voting machine of claim 11 further including at selected rows of voting keys, straight party means for each selected row including:

a second abutment means on said keys;

second moveable bar means adapted to engage said second abutment means to move said keys to a voted position;

second clutch means including a second driver clutch member connected to said common drive shaft and a second driven clutch member connected to said second bar means and adapted to drive same; and means for engaging said second clutch means to move said second bar means in engagement with said second abutment means.

15. The voting machine of claim 11 further including cam means adapted to sequentially control the actuation of said first and second clutch means wherein actuation of said means for engaging with second clutch means will first engage and disengage said first clutch means to clear said voting keys.

16. The voting machine of claim 11 wherein said registering means comprise mechanical tally counters.

17. The voting machine of claim 16 further including means for punching a computer compatible card in accordance with a voter key selection.

18. The voting machine of claim 12 wherein said power means include an electric motor and control circuit, switch means in said circuit, switch arm means carrying said switch means, means associated with said main control means for moving said switch arm means to a first position to close said switch means and energize said motor and means for returning said switch arm means to a second position after said keys have been moved to said non-voted position to open said switch means.

19. The voting machine of claim 18 wherein said means for returning said switch include biasing means extending between said switch arm means and a member positionable by said clearing means, said member tensioning said spring only when said bar means has moved said keys to said non-voted position.

20. The voting machine of claim 18 further including at selected rows of voting keys, straight party means for each selected row including:

second abutment means on said keys;

second moveable bar means adapted to engage said second abutment means to move said keys to a voted position;

second clutch means adapted to drive said second bar means; and voter actuated means for moving said switch means to said second position to energize said electric motor to operate said staight party means.

21. A voting machine comprising:

a columnar frame;

a plurality of voting keys arranged in said frame and movable between a voted position and an unvoted position;

selection means on said frame connected to said voting keys including an actuable staight party selector for moving selected ones of said voting keys to the voted position in response to actuation of said straight party selector, said selected keys being representative of a straight party vote; and clearing means associated with said selector means and said voting keys to move all of said voting keys which are in the voted position to the unvoted position in response to actuation of said straight party selector preparatory to said selection means moving said selected keys to the voted position, whereby said voting keys are cleared before said straight party vote is registered to prevent malfunctioning of said voting machine.

22. The voting machine of claim 21 and further comprising drive means common to said selection means and said clearing means for mutually exclusively driving said selection means and said clearing means.

23. The voting machine of claim 22 and further comprising first clutch means in communication with said drive means for engaging said drive means with said selection means and second clutch means in communication with said drive means for engaging said drive means with said clearing means.

* * * * *

UNITED STATES PATENT AND TRADEMARK OFFICE

CERTIFICATE OF CORRECTION

PATENT NO. : 3,934,793

DATED : January 27, 1976

INVENTOR(S) : Cothburn M. O'Neal; Alfred M. Mayo

It is certified that error appears in the above-identified patent and that said Letters Patent are hereby corrected as shown below:

Col. 1, line 11, "cna" should be --can--.
Col. 2, line 65, "veiw" should be --view--.
Col. 4, line 25, after "operation" insert --of--.
Col. 4, line 46, "wil" should be --will--.
Col. 5, line 66, "hold 68" should be --bore 68--.
Col. 6, line 15, "cam" should be --Cam--.
Col. 6, line 27, "whicih" should be --which--.
Col. 6, line 27, "column", second occurrence, should be --Column--.
Col. 6, line 40, after "action" insert --.-- and delete "to".

Col. 7, line 51, "85a" should be --85i--.
Col. 7, line 53, "92a" should be --92i--.
Col. 9, line 25, "130b" should be --130a--.
Col. 10, line 65, "officail" should be --official--.
Col. 11, line 24, delete "buttonn".
Col. 11, line 24, insert --is-- between "button" and "not".
Col. 11, line 53, "Parallel" should start a new paragraph.
Col. 11, line 63, after "236" insert --to--.
Col. 12, line 32, "31" should be --301--.
Col. 13, line 29, "locked" insert --to--.
Col. 13, line 35, "prevent" should be --prevents--.

Col. 15, line 19, "case" should be --cast--.
Col. 15, line 68, "231" should be --213--.
Col. 16, line 48, after "four" insert --bar--.
Col. 17, line 2, after "various" insert --ballot--.
Col. 17, line 7, after "intentionally" insert --or--.
Col. 17, line 23, "and" should be --an--.
Col. 17, line 53, after "voting" insert --.--.
Col. 18, line 6, after "button", both occurrences, insert --23--.
Col. 18, line 8, delete "vote button" and insert --slide--.
Col. 18, line 25, delete "a".
Col. 19, line 37, "seocnd" should be --second--.

UNITED STATES PATENT AND TRADEMARK OFFICE

CERTIFICATE OF CORRECTION

PATENT NO. : 3,934,793

DATED : January 27, 1976

INVENTOR(S) : Cothburn M. O'Neal; Alfred M. Mayo

It is certified that error appears in the above-identified patent and that said Letters Patent are hereby corrected as shown below:

Col. 20, line 34, delete "and further" (repeated).
Col. 22, line 12, "staight" should be --straight--.

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*